US010107151B2

(12) United States Patent
Mukaide et al.

(10) Patent No.: US 10,107,151 B2
(45) Date of Patent: Oct. 23, 2018

(54) CONTROL VALVE

(71) Applicant: AISIN SEIKI KABUSHIKI KAISHA, Kariya-shi, Aichi (JP)

(72) Inventors: Hiroki Mukaide, Chiryu (JP); Shigemitsu Suzuki, Takahama (JP); Naoto Toma, Kariya (JP)

(73) Assignee: AISIN SEIKI KABUSHIKI KAISHA, Kariya-shi, Aichi (JP)

( * ) Notice: Subject to any disclaimer, the term of this patent is extended or adjusted under 35 U.S.C. 154(b) by 278 days.

(21) Appl. No.: 15/107,019

(22) PCT Filed: Dec. 22, 2014

(86) PCT No.: PCT/JP2014/083943
§ 371 (c)(1),
(2) Date: Jun. 21, 2016

(87) PCT Pub. No.: WO2015/098858
PCT Pub. Date: Jul. 2, 2015

(65) Prior Publication Data

US 2018/0149043 A1 May 31, 2018

(30) Foreign Application Priority Data

Dec. 25, 2013 (JP) ..... 2013-267656
Feb. 26, 2014 (JP) ..... 2014-035772

(51) Int. Cl.
*F01L 1/344* (2006.01)
*F01L 1/46* (2006.01)

(52) U.S. Cl.
CPC ..... *F01L 1/3442* (2013.01); *F01L 1/46* (2013.01); *F01L 2001/3443* (2013.01); *F01L 2001/34463* (2013.01)

(58) Field of Classification Search
CPC ..... F01L 2001/3443; F01L 2001/34453; F01L 2001/34463; F01L 1/46
(Continued)

(56) References Cited

U.S. PATENT DOCUMENTS

2001/0052330 A1* 12/2001 Takenaka ..... F01L 1/3442 123/90.17
2003/0121486 A1 7/2003 Komazawa et al.
(Continued)

FOREIGN PATENT DOCUMENTS

JP 2002-250207 A 9/2002
JP 2001-355414 A 5/2003
(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) dated Jul. 7, 2016 by the international Bureau of WIPO in corresponding International Application No. PCT/JP2014/083943. (9 pages).
(Continued)

*Primary Examiner* — Jorge Leon, Jr.
(74) *Attorney, Agent, or Firm* — Buchanan Ingersoll & Rooney PC

(57) ABSTRACT

This disclosure reliably causes transition to a locked state at the time of internal combustion engine deactivation and reliably causes transition to the locked state when a locking mechanism is not in the locked state at the time of internal combustion engine activation. A control valve spool is operable to a phase control position in which the supply/discharge of a fluid to/from an advance port and a retard port is controlled while the fluid is supplied to a lock releasing port, and to a lock transition position in which the supply/
(Continued)

discharge of the fluid to/from the advance port and the retard port is controlled while the fluid is discharged from the lock releasing port. A communication path through which a portion of the fluid from a pump port is discharged to a drain port when the spool is operated to the lock transition position is formed.

13 Claims, 21 Drawing Sheets

(58) Field of Classification Search
USPC ..... 123/90.17
See application file for complete search history.

(56) References Cited

U.S. PATENT DOCUMENTS

| | | | | |
|---|---|---|---|---|
| 2003/0196626 | A1 | 10/2003 | Smith et al. | |
| 2010/0319641 | A1 | 12/2010 | Suzuki et al. | |
| 2011/0293401 | A1 | 12/2011 | Sekita et al. | |
| 2012/0017859 | A1 | 1/2012 | Numakura et al. | |
| 2012/0186547 | A1* | 7/2012 | Fujiyoshi ..... | F01L 1/3442 123/90.17 |
| 2012/0291750 | A1 | 11/2012 | Yokoyama et al. | |
| 2013/0008397 | A1 | 1/2013 | Takada | |
| 2013/0068183 | A1 | 3/2013 | Takada | |

FOREIGN PATENT DOCUMENTS

| | | | |
|---|---|---|---|
| JP | 2004-68808 | A | 3/2004 |
| JP | 2010-248950 | A | 11/2010 |
| JP | 2011-1852 | A | 1/2011 |
| JP | 2013-19282 | A | 1/2013 |
| JP | 2013-064380 | A | 4/2013 |
| JP | 2013-68308 | A | 4/2013 |
| WO | WO 2011/099124 | A1 | 8/2011 |

OTHER PUBLICATIONS

International Search Report (PCT/ISA/210) dated Feb. 10, 2015, by the Japanese Patent Office as the International Searching Authority for International Application No. PCT/JP2014/083943.
Written Opinion (PCT/ISA/237) dated Feb. 10, 2015, by the Japanese Patent Office as the International Searching Authority for International Application No. PCT/JP2014/083943.

* cited by examiner

| | PA1 | PA2 | PL | PB2 | PB1 |
|---|---|---|---|---|---|
| Advance chamber | Supply / Discharge | Supply | Block | Discharge | Discharge |
| Retard chamber | Discharge | Discharge | Block | Supply | Supply / Discharge |
| Intermediate locking recess portion | Discharge | Supply | Supply | Supply | Discharge |

| | PA1 | PA2 | PL | PB2 | PB1 |
|---|---|---|---|---|---|
| Advance chamber | Supply / Discharge / Close | Supply | Block | Discharge | Discharge |
| Retard chamber | Discharge | Discharge | Block | Supply | Supply / Close / Discharge |
| Intermediate locking recess portion | Discharge | Supply | Supply | Supply | Discharge |

| Power | o ← → Maximum | | | | |
|---|---|---|---|---|---|
| Spool position | PA1 | PA2 | PL | PB2 | PB1 |
| Advance chamber | Supply | Supply | Block | Discharge | Discharge |
| | Communicate | | | | Communicate |
| Retard chamber | Discharge | Discharge | Block | Supply | Supply |
| Intermediate locking recess portion | Discharge | Supply | Supply | Supply | Discharge |

Fig.24

| Power | 0 ←→ Maximum | | | |
|---|---|---|---|---|
| Spool position | PA | | N | PB |
| Advance chamber | Supply | Supply | Close | Discharge |
| | Communicate | | | |
| Retard chamber | Discharge | Discharge | Close | Supply |

CONTROL VALVE

TECHNICAL FIELD

The present invention relates to a control valve for a valve opening/closing timing control apparatus that includes a driving-side rotary body that synchronously rotates with a crankshaft and a driven-side rotary body that is connected to a camshaft, and more particularly to a control valve that controls a fluid supplied to one of an advance chamber and a retard chamber of the valve opening/closing timing control apparatus.

BACKGROUND ART

Patent Document 1 discloses, as control valves for a valve opening/closing timing control apparatus, a phase control valve (relative rotation OCV in the document) that sets a relative rotation phase by selectively supplying a fluid to one of an advance chamber and a retard chamber and a lock control valve (regulation OCV in the document) that releases a regulated state by supplying a fluid to a regulating member of a locking mechanism.

According to Patent Document 1, a spool constituting the phase control valve and a spool constituting the lock control valve are housed in a single valve body, and part of the valve body is fitted into a driven-side rotary body of the valve opening/closing timing control apparatus so as to be capable of rotation relative to each other.

Patent Document 2 discloses a control valve in which a spool (spool valve body in the document) is housed within a valve body so as to be capable of sliding. The control valve is configured to be capable of being operated to be in six positions, and is also configured such that a locking mechanism can be controlled by selecting any one of the six positions so as to displace the relative rotation phase of a valve opening/closing timing control apparatus (valve timing control apparatus in the document) in an advance direction or a retard direction.

CITATION LIST

Patent Literature

Patent Document 1: JP 2011-1852A
Patent Document 2: JP 2013-19282A

SUMMARY OF INVENTION

Technical Problem

As disclosed in Patent Document 1, in the configuration including a phase control valve and a lock control valve, it is necessary to use two spools, which results in a large number of components. This causes not only an increase in size but also an increase in cost.

With the configuration disclosed in Patent Document 2, control of the relative rotation phase and control of the locking mechanism in the valve opening/closing timing control apparatus are performed by using a single spool, and thus it is possible to reduce the number of components.

As disclosed in Patent Documents 1 and 2, in a vehicle in which a fluid from a fluid pressure pump driven in an internal combustion engine is supplied to a valve opening/closing timing control apparatus through a control valve, control is performed to bring a locking mechanism into a locked state so as to deactivate the internal combustion engine. As a result of the locking mechanism being transitioned to the locked state, when the internal combustion engine is activated after that, even if the fluid supplied from a fluid pressure pump has a low fluid pressure, the relative rotation phase of the valve opening/closing timing control apparatus is maintained at a predetermined phase (locked phase), and thus the activation performance of the internal combustion engine is improved.

However, with a valve opening/closing timing control apparatus including a locking mechanism configured to maintain the relative rotation phase, in which a locking member is engaged in a locking recess portion, at a locked phase, at the time of deactivation of the internal combustion engine, a situation may arise in which it is not possible to bring the locking mechanism into the locked state even when the relative rotation phase of the valve opening/closing timing control apparatus is controlled. The relative rotation phase being displaced at a high speed is considered to be a cause of this. That is, when the relative rotation phase is displaced at a high speed, even though the locking member reaches the relative rotation phase in which the locking member can be engaged in the locking recess portion, a phenomenon in which the locking member cannot be engaged in the locking recess portion occurs.

In addition, there is a disadvantage in that when the internal combustion engine is deactivated while the locking mechanism is not in the locked state, such as an engine stall, and thereafter the internal combustion engine is activated, the relative rotation phase of the valve opening/closing timing control apparatus varies in a short period of time due to a reactive force exerted from the camshaft. In order to overcome this disadvantage, a rapid transition to the locked state is required at the time of activation of the internal combustion engine, but as described above, when the relative rotation phase is displaced at a high speed, it is not possible to reliably cause the transition to the locked state to be performed, and thus there is room for improvement.

It is an object of the present invention to provide a reasonable configuration of a control valve that reliably causes transition to a locked state at the time of deactivation of an internal combustion engine and that reliably causes transition to the locked state when a locking mechanism is not in the locked state at the time of activation of the internal combustion engine.

Solution to Problem

A feature of the present invention lies in a control valve for a valve opening/closing timing control apparatus including: a driving-side rotary body that synchronously rotates with a crankshaft of an internal combustion engine; a driven-side rotary body that rotates together with a camshaft of the internal combustion engine and rotates relative to the driving-side rotary body, a relative rotation phase between the driving-side rotary body and the driven-side rotary body being displaced in an advance direction by a fluid being supplied to an advance chamber and being displaced in a retard direction by the fluid being supplied to a retard chamber; and a locking mechanism that holds the relative rotation phase to a predetermined locked phase by engagement of a locking member with an engaging portion formed on one of the driving-side rotary body and the driven-side rotary body, the locking member being supported by the other of the driving-side rotary body and the driven-side rotary body, the control valve including: a valve case; a spool housed in the valve case; and an electromagnetic solenoid that drives the spool such that the spool moves along an axis of the spool, the valve case including: a pump port to which the fluid is supplied; an advance port that communicates with the advance chamber; a retard port that communicates with the retard chamber; a lock releasing port that communicates with a lock releasing space of the locking member; and a drain port that allows the fluid to be discharged, wherein the spool is configured to be movable between a plurality of phase control positions and a lock transition position, the phase control positions being set to control supply and discharge of the fluid to and from the advance port and the retard port when the fluid is supplied to the lock releasing port, and the lock transition position being set to control supply and discharge of the fluid to and from the advance port and the retard port when the fluid is discharged from the lock releasing port, and a communication path that allows a portion of the fluid supplied to the pump port to flow into the drain port when the spool is set to the lock transition position is formed.

In this configuration, when the spool is set to a lock transition position, a portion of the fluid from the pump port is discharged from the communication path to the drain port. As a specific configuration, when the lock transition position is a lock transition position in which the fluid from the pump port is supplied to the advance port, in this position, a portion of the fluid supplied to the advance port is discharged from the communication path to the drain port. Consequently, the amount of fluid supplied to the advance chamber per unit time is reduced, and the speed of displacement of the relative rotation phase between the driving-side rotary body and the driven-side rotary body in the advance direction is reduced, as a result of which the locking member of the locking mechanism can be easily engaged with the engaging portion.

That is, at the time of control for deactivating the internal combustion engine, when the spool is operated to be in a lock transition position so as to cause transition to a locked state established by the locking mechanism, the speed of displacement of the relative rotation phase is reduced to reliably cause transition to the locked state. Also, at the time of activation of the internal combustion engine while the locking mechanism is not in the locked state, when the spool is operated to be in a lock transition position, the speed of displacement of the relative rotation phase is reduced to reliably cause transition of the locking mechanism to the locked state.

The reduction of the speed of displacement of the relative rotation phase is also performed when the lock transition position is a lock transition position in which the fluid is supplied to the retard port, and thereby the transition of the locking mechanism to the locked state is reliably performed.

Accordingly, a control valve that reliably causes transition to a locked state at the time of deactivation of an internal combustion engine and that reliably causes transition to the locked state when a locking mechanism is not in the locked state at the time of activation of the internal combustion engine can be achieved.

Furthermore, when the spool is set to a lock transition position, one of the advance chamber and the retard chamber communicates with the drain port, and the other chamber communicates with the drain port via the communication path. Accordingly, when a starter motor is driven to activate the internal combustion engine while the locking mechanism is not in the locked state, by setting the spool to be in a lock transition position, it is possible to rapidly discharge the fluid from the advance chamber and the retard chamber due to varying torque exerted from the intake camshaft and cause the locking mechanism to rapidly transition to the locked state. A specific operating configuration is as follows: an operation is repeated in which, when the volume of one of the advance chamber and the retard chamber increases, the volume of the other chamber decreases, as with respiration, by the action of varying torque, and it is therefore possible to cause pressure to act on the fluid remaining in the advance chamber and the retard chamber and reliably discharge the fluid. With this configuration, with the resistance of the fluid being eliminated, the relative rotation phase can be rapidly displaced to the locked phase to enable the transition to the locked state to be performed, as compared with the case where, for example, the relative rotation phase is displaced to the locked phase while the fluid remains in the advance chamber or the retard chamber.

In the present invention, one of the lock transition positions in which the fluid is supplied to the advance port may be disposed in a position adjacent to one of the phase control positions in which the fluid is supplied to the advance port, one of the lock transition positions in which the fluid is supplied to the retard port may be disposed in a position adjacent to one of the phase control positions in which the fluid is supplied to the retard port, and the communication path may be closed in a region of the lock transition position, the region being adjacent to the phase control position.

When changing the relative rotation phase of the valve opening/closing timing control apparatus, the spool is operated to be in a phase control position, and thus the spool is not operated to be in a lock transition position. Also, in an example of a configuration in which a communication path through which a portion of the fluid from the pump port is discharged to the drain port when the spool is set to a lock transition position, if, for example, the spool overshoots and reaches part of the lock transition position when the spool is operated from a phase control position to the lock transition position, the fluid supplied to the advance port or the retard port is not discharged to the communication path, and thus the speed of displacement of the relative rotation phase is not reduced.

In the present invention, a phase control flow path that allows the fluid to be supplied from the pump port to the advance port and the retard port may be formed in the spool, and the communication path may have a cross-sectional flow area smaller than a cross-sectional flow area of the phase control flow path.

With this configuration, when the spool is set to a lock transition position, a portion of the fluid from the pump port is discharged to the drain port through the communication path, but the amount of fluid discharged as described above is less than the amount of fluid supplied to the advance port or the retard port, and thus the disadvantage of a significant reduction in the speed of displacement of the relative rotation phase is suppressed. Accordingly, the relative rotation phase of the valve opening/closing timing control apparatus can be displaced slowly and the transition to the locked state can be reliably performed.

In the present invention, the drain port may include a lock releasing drain port that allows the fluid from the lock releasing port to be discharged to outside of the valve case and a phase controlling drain port that allows the fluid from the communication path to be discharged to the outside of the valve case.

With this configuration, in the case where the fluid is discharged through the flow path when the fluid from the lock releasing port is ejected from the lock releasing drain port to the outside of the valve case, the fluid is ejected from the phase controlling drain port to the outside of the valve case. For this reason, these discharges do not affect each other, and the amount of fluid flowing through the communication path is not reduced. Furthermore, it is unnecessary to increase the speed of displacement of the relative rotation phase, and the transition of the locking mechanism to the locked state can be favorably performed.

In the present invention, the phase controlling drain port may have a function of allowing the fluid from the advance port to be discharged to the outside of the valve case and a function of allowing the fluid from the retard port to be discharged to the outside of the valve case.

With this configuration, the influence of fluid discharged from the lock releasing port can be eliminated without forming a dedicated drain port for discharging the fluid from the communication path.

Another feature of the present invention lies in a control valve including: a valve case, the valve case including a main port through which a fluid expelled from an external fluid pressure pump is supplied, a first port and a second port that allow the fluid flowed into the main port to flow into an advance chamber or a retard chamber of a valve opening/closing timing control apparatus included in an internal combustion engine provided outside or to flow out of the advance chamber or the retard chamber, and a third port that allows the fluid flowing from the valve opening/closing timing control apparatus via the first port or the second port to be discharged; a spool included in the valve case to be reciprocatable between one end and the other end of the valve case; and an electromagnetic solenoid that drives and operates the spool, wherein when the spool is positioned at one end or the other end of the valve case, the main port communicates with the first port, and the second port communicates with the third port, the second port also communicates with the main port.

For example, in a configuration in which the first port communicates with the advance chamber of the valve opening/closing timing control apparatus, and the second port communicates with the retard chamber, when the spool is positioned at one end of the valve case, the fluid from the main port is supplied to the advance chamber via the first port, and the fluid of the retard chamber is discharged from the second port to the third port. At the same time, the second port communicates with the main port so as to supply the fluid from the third port to the retard chamber.

Also, at the time of activation of the internal combustion engine, there is almost no fluid in the advance chamber and the retard chamber of the valve opening/closing timing control apparatus. In this situation, if a cam varying torque is exerted from the camshaft, it causes a variation (phenomenon in which the relative rotation phase rapidly varies alternately between the advance direction and the retard direction) in the relative rotation phase of the valve opening/closing timing control apparatus. However, according to the present invention, when the locking mechanism is in the locked state at the time of activation of the internal combustion engine, the advance chamber and the retard chamber can be filled with the fluid, and thus the variation of the relative rotation phase can be suppressed even if the locked state is released after that.

Furthermore, according to the present invention, when the locking mechanism is not in the locked state at the time of activation of the internal combustion engine, the amount of fluid supplied to the advance chamber is reduced so as to reduce the speed of displacement of the relative rotation phase in the advance direction. Accordingly, the transition of the locking mechanism to the locked state can be reliably performed.

Another feature of the present invention lies in that the valve opening/closing timing control apparatus includes a locking mechanism that is operated by the fluid so as to fix a valve opening/closing timing to an intermediate phase between a maximum advance phase and a maximum retard phase, and the valve case includes: a sub-port that receives the fluid from the fluid pressure pump; a fourth port that allows the fluid flowing out of the sub-port to flow into the locking mechanism or to flow out of the locking mechanism; and a fifth port that sets the locking mechanism to a locked state by allowing the fluid flowing from the locking mechanism via the fourth port to be discharged when the spool is positioned at an end of the valve case.

With this configuration, when the spool is positioned at one end of the valve case, by discharging the fluid from the fourth port via the fifth port, the transition of the locking mechanism to the locked state can be reliably performed. Also, after the locked state of the locking mechanism in the locked state has been released, the fluid can be supplied to the advance chamber and the retard chamber, and thus the variation of the relative rotation phase of the valve opening/closing timing control apparatus can be suppressed even when the locked state has been released.

In the present invention, a biasing member that biases the spool to one end of the valve case when power supplied to the electromagnetic solenoid reaches zero may be provided.

With this configuration, when it is necessary to provide power to a starter motor or the like, such as at the time of activation of the internal combustion engine, the spool can be held at one end of the valve case due to the biasing force of the biasing member without consuming power. Consequently, the speed of displacement of the relative rotation phase can be reduced without supplying power to the electromagnetic solenoid.

In the present invention, the spool may be positioned at the other end of the valve case when the power supplied to the electromagnetic solenoid reaches a maximum level, and at the same time, the main port may communicate with the second port, and the first port may communicate with the third port and the main port so as to cause the advance chamber and the retard chamber to communicate with each other.

With this configuration, when the power supplied to the electromagnetic solenoid reaches a maximum level, the spool is positioned in the other end of the valve case. In a configuration in which the first port communicates with the advance chamber of the valve opening/closing timing control apparatus and the second port communicates with the retard chamber, the fluid from the main port is supplied from the second port to the retard chamber, and the fluid of the advance chamber is discharged from the first port to the third port. At the same time, the advance chamber and the retard chamber communicate with each other.

As described above, for example, when deactivating the internal combustion engine, the relative rotation speed of the valve opening/closing timing control apparatus can be reduced, and the transition to the locked state can be easily performed in the locked phase.

The present invention is configured such that when the spool is positioned at one of two ends of the valve case, and the first port or the second port communicates with the third port and the main port, the first port or the second port communicating with the main port has an opening area larger than an area of an opening communicating with the third port.

With this configuration, for example, in a configuration in which the fluid from the main port is supplied to the first port, the main port communicates with the first port so as to supply the fluid thereto, and at the same time, the first port communicates with the third port to discharge the fluid. In this case, the area of the opening of the first port communicating with the main port is larger than the area of the opening communicating with the third port. Accordingly, the amount of fluid discharged from the first port to the third port is limited.

As a result of the amount of fluid discharged from the first port or the second port to the third port being limited, the displacement of the relative rotation phase of the valve opening/closing timing control apparatus can be reliably performed.

The present invention is configured such that when the spool is positioned at one of the two ends of the valve case and the first port or the second port communicates with the third port and the main port, a portion of a communication path communicating with the main port has an opening area larger than an opening area of a portion of the communication path communicating with the third port, the communication path which communicates from the main port to the third port.

With this configuration, for example, in a configuration in which the fluid from the main port is supplied to the first port, the main port communicates with the first port so as to supply the fluid thereto, and at the same time, the first port communicates with the third port to discharge the fluid. In this case, in the communication path which communicates from the main port to the third port, the opening area of the portion of the communication path communicating with the main port is larger than the opening area of the portion of the communication path communicating with the third port. Accordingly, the amount of fluid discharged directly from the main port to the third port is limited.

As a result of the amount of fluid discharged directly from the main port to the third port being limited, the displacement of the relative rotation phase of the valve opening/closing timing control apparatus can be reliably performed.

In the present invention, a biasing member that biases the spool to one end of the valve case may be provided, and the spool may be disposed at one end of the valve case when an electromagnetic force of the electromagnetic solenoid is smaller than a biasing force of the biasing member.

With this configuration, when power is supplied to the electromagnetic solenoid, and the electromagnetic force generated by the supply of power is smaller than the biasing force of the biasing member, the spool is maintained at one end of the valve case.

In the present invention, a biasing member that biases the spool to the other end of the valve case may be provided, and the spool may be disposed at the other end of the valve case when an electromagnetic force of the electromagnetic solenoid is greater than a biasing force of the biasing member.

With this configuration, when power is supplied to the electromagnetic solenoid, and the electromagnetic force generated by the supply of power is greater than the biasing force of the biasing member, the spool is maintained at the other end of the valve case.

BRIEF DESCRIPTION OF DRAWINGS

FIG. 24 shows, in the form of a list, a supply/discharge relationship of hydraulic oil with respect to the position of the spool according to Variation (2a) of the second embodiment.

DESCRIPTION OF EMBODIMENTS

Hereinafter, a first embodiment according to the present invention will be described with reference to the drawings.

Basic Configuration

Figure 1:
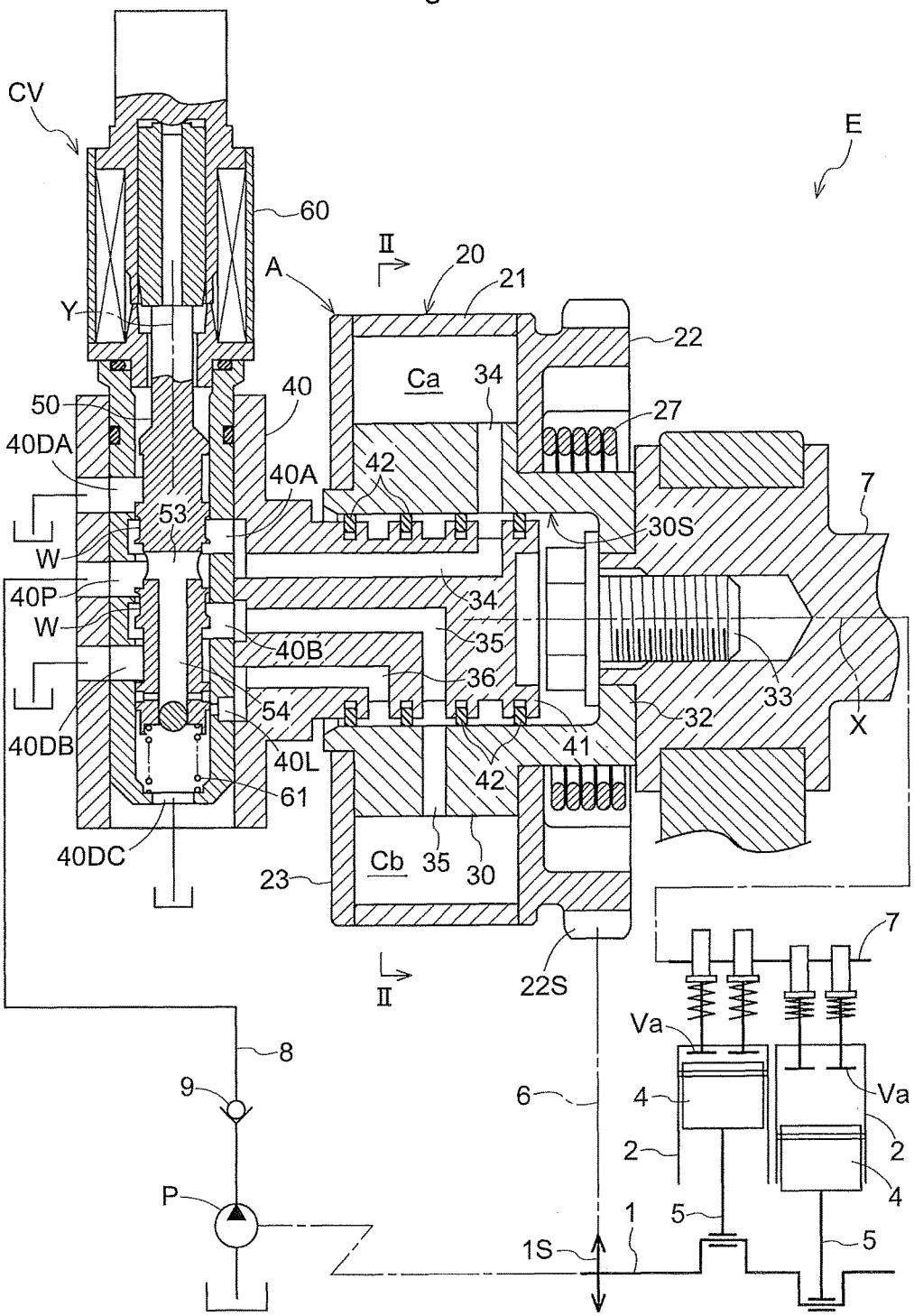
FIG. 1 is a cross-sectional view of a valve opening/closing timing control apparatus including a control valve according to a first embodiment.
Figure 2:
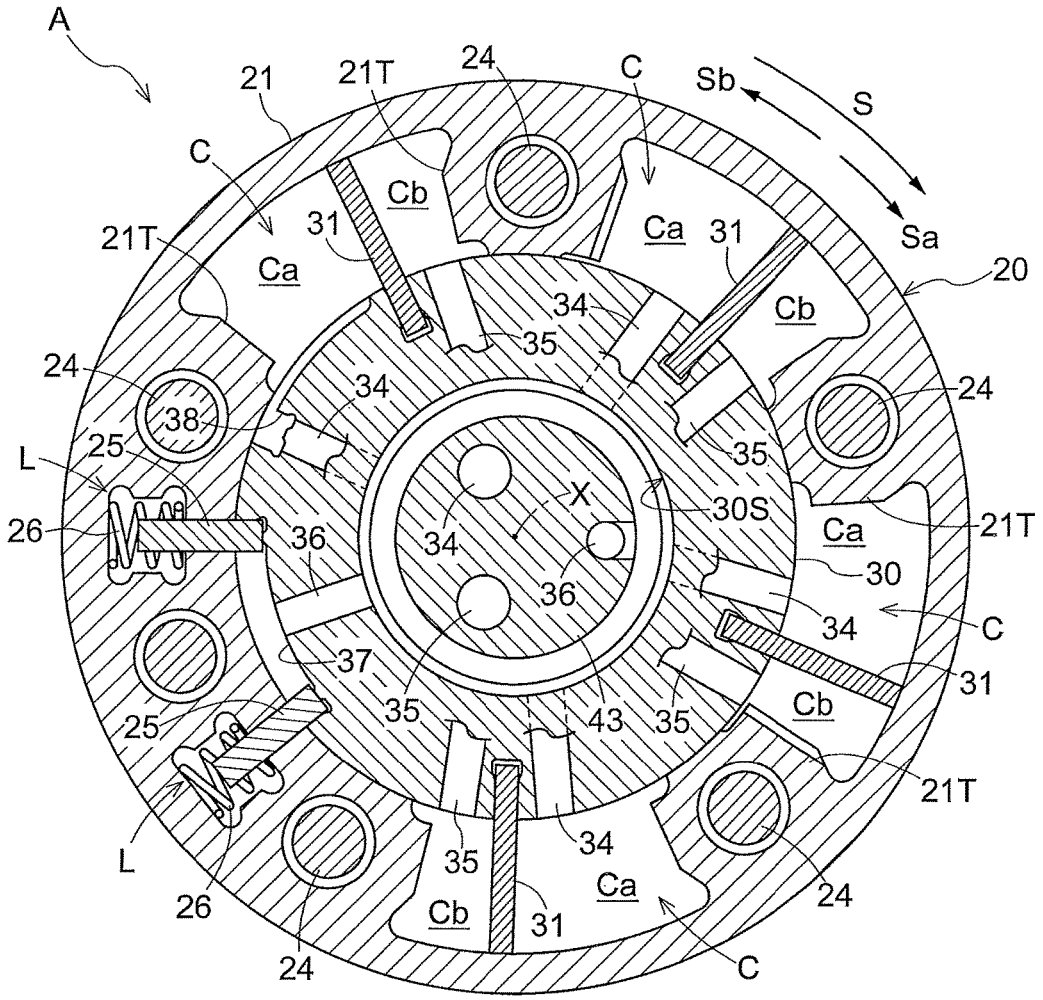
FIG. 2 is a cross-sectional view taken along the line II-II shown in FIG. 1.

As shown in FIGS. 1 and 2, an engine E, which is an internal combustion engine, includes a valve opening/closing timing control apparatus A that sets the opening/closing timing (opening and closing times) of an intake valve Va. The valve opening/closing timing control apparatus A is configured to set the opening/closing timing of the intake valve Va in response to supply and discharge of hydraulic oil, which is a fluid, by an electromagnetically operable control valve CV.

The engine E (an example of the internal combustion engine) is mounted on a vehicle such as a passenger car. The engine E is a four-stroke cycle engine in which a piston 4 is housed within a cylinder bore formed in a cylinder block 2, and the piston 4 is connected to a crankshaft 1 by a connecting rod 5.

The valve opening/closing timing control apparatus A includes an outer rotor 20, which is a driving-side rotary body that synchronously rotates with the crankshaft 1 of the engine E, and an inner rotor 30, which is a driven-side rotary body that rotates together with an intake camshaft 7 that controls the intake valve Va of the engine E. An advance chamber Ca and a retard chamber Cb are provided between the outer rotor 20 (an example of the driving-side rotary body) and the inner rotor 30 (an example of the driven-side rotary body). Also, a locking mechanism L that locks (fixes) a relative rotation phase between the outer rotor 20 and the inner rotor 30 to an intermediate locked phase is provided.

The engine E includes an oil pressure pump P (an example of the fluid pressure pump) that is driven by a driving force of the crankshaft 1. The oil pressure pump P supplies, as hydraulic oil (an example of the fluid), a lubricant stored in an oil pan of the engine E from a supply flow path 8 to the control valve CV. The control valve CV is supported by the engine E, with a shaft-like portion 41 formed unitary with a valve case 40 being inserted into the inner rotor 30. The control valve CV supplies and discharges the hydraulic oil to and from the valve opening/closing timing control apparatus A via flow paths formed within the shaft-like portion 41. The supply flow path 8 is provided with a check valve 9 that prevents back flow of the hydraulic oil.

With this configuration, the control valve CV selects one of the advance chamber Ca and the retard chamber Cb, supplies the hydraulic oil to the selected chamber so as to change the relative rotation phase between the outer rotor 20 and the inner rotor 30 (hereinafter referred to as "relative rotation phase"), and sets the opening/closing timing of the intake valve Va. Furthermore, the control valve CV releases a locked state established by the locking mechanism L by supplying the hydraulic oil.

The control valve CV is not necessarily supported in a position shown in FIG. 1, and may be supported by a member that is spaced apart from the valve opening/closing timing control apparatus A. In this case, the flow path is formed between the control valve CV and the valve opening/closing timing control apparatus A.

The present embodiment shows a configuration in which the valve opening/closing timing control apparatus A is provided on the intake camshaft 7, but the valve opening/closing timing control apparatus A may be provided on an exhaust camshaft. Alternatively, the valve opening/closing timing control apparatus A may be provided on both the intake camshaft 7 and the exhaust camshaft.

Specific Configuration of Valve Opening/Closing Timing Control Apparatus

As shown in FIGS. 1 to 4, in the valve opening/closing timing control apparatus A, the inner rotor 30 is accommodated within the outer rotor 20, and these rotors are coaxially disposed about a rotation axis X of the intake camshaft 7 so as to be capable of rotation relative to each other. A timing chain 6 is wound between a driving sprocket 22S formed in the outer rotor 20 and a sprocket 1S driven by the crankshaft 1.

The inner rotor 30 is connected to the intake camshaft 7 by a connection bolt 33.

The outer rotor 20 includes a rotor main body 21 having a cylindrical shape, a rear block 22 disposed at one end of the rotor main body 21 in a direction extending along the rotation axis X, and a front plate 23 disposed at the other end of the rotor main body 21 in the direction extending along the rotation axis X. The rear block 22 and the front plate 23 are fastened to the rotor main body 21 by a plurality of fastening bolts 24. The driving sprocket 22S that receives a rotational force transmitted from the crankshaft 1 is provided on the outer circumference of the rear block 22. In the rotor main body 21, a cylindrical inner wall surface and a plurality of protruding portions 21T that protrude in a direction approaching the rotation axis X (radially inwardly) are formed as a unitary structure.

A pair of guide grooves are formed on one of the plurality of protruding portions 21T so as to extend radially from the rotation axis X. A plate-like locking member 25 is inserted into each of the guide grooves so as to be capable of advancing and retracting, and a locking spring 26 that biases the locking member 25 in a direction approaching the rotation axis X (locking direction) is provided. As described above, the locking mechanism L is constituted by the locking member 25 and the locking spring 26 that biases the locking member 25 in a protruding direction. The shape of the locking member 25 is not limited to a plate shape, and may be, for example, a rod shape. The locking mechanism L may be constituted by a single locking member 25.

The inner rotor 30 has an inner circumferential surface 30S, which is a cylindrical inner surface disposed coaxially with the rotation axis X, and a columnar outer circumferential surface having the rotation axis X as the center. A flange-like portion 32 is provided at one end of the inner rotor 30 in the direction extending along the rotation axis X, and the inner rotor 30 is connected to the intake camshaft 7 by the connection bolt 33 passing through a hole formed in an inner position of the flange-like portion 32.

The outer circumferential surface of the inner rotor 30 includes a plurality of outwardly protruding vanes 31. With this configuration, as a result of the inner rotor 30 being fitted (accommodated) into the outer rotor 20, fluid pressure chambers C are formed in regions surrounded by the inner surface (the cylindrical inner wall surface and the plurality of protruding portions 21T) of the rotor main body 21 and the outer circumferential surface of the inner rotor 30. Furthermore, as a result of each fluid pressure chamber C being divided by one of the vanes 31, advance chambers Ca and retard chambers Cb are formed. In the inner rotor 30, advance flow paths 34 that communicate with the advance chambers Ca, retard flow paths 35 that communicate with the retard chambers Cb, and lock releasing flow paths 36 are formed.

In the outer circumference of the inner rotor 30, an intermediate locking recess portion 37 (an example of the engaging portion and the lock releasing space) is formed with which a pair of locking members 25 can be engaged and disengaged. Also, in the outer circumference of the inner rotor 30, a maximum retard locking recess portion 38 is formed with which one of the pair of locking members 25 is engaged in a maximum retard locked phase displaced in a retard direction Sb from the intermediate locked phase in which the pair of locking members 25 are simultaneously engaged with the intermediate locking recess portion 37.

The lock releasing flow path 36 is in communication with the intermediate locking recess portion 37, and the advance flow path 34 is in communication with the maximum retard locking recess portion 38.

Figure 3:
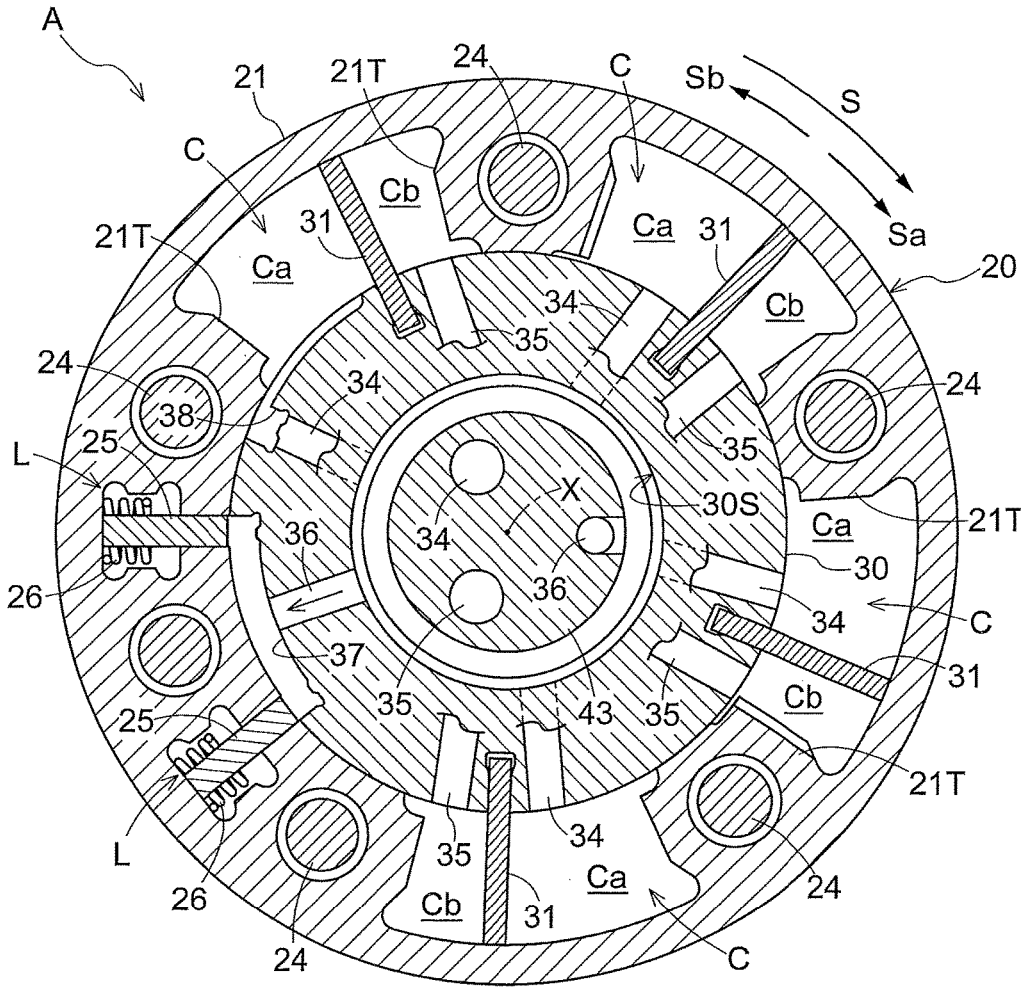
FIG. 3 is a cross-sectional view of the valve opening/closing timing control apparatus when it is in a lock released state.
Figures 4, 5:
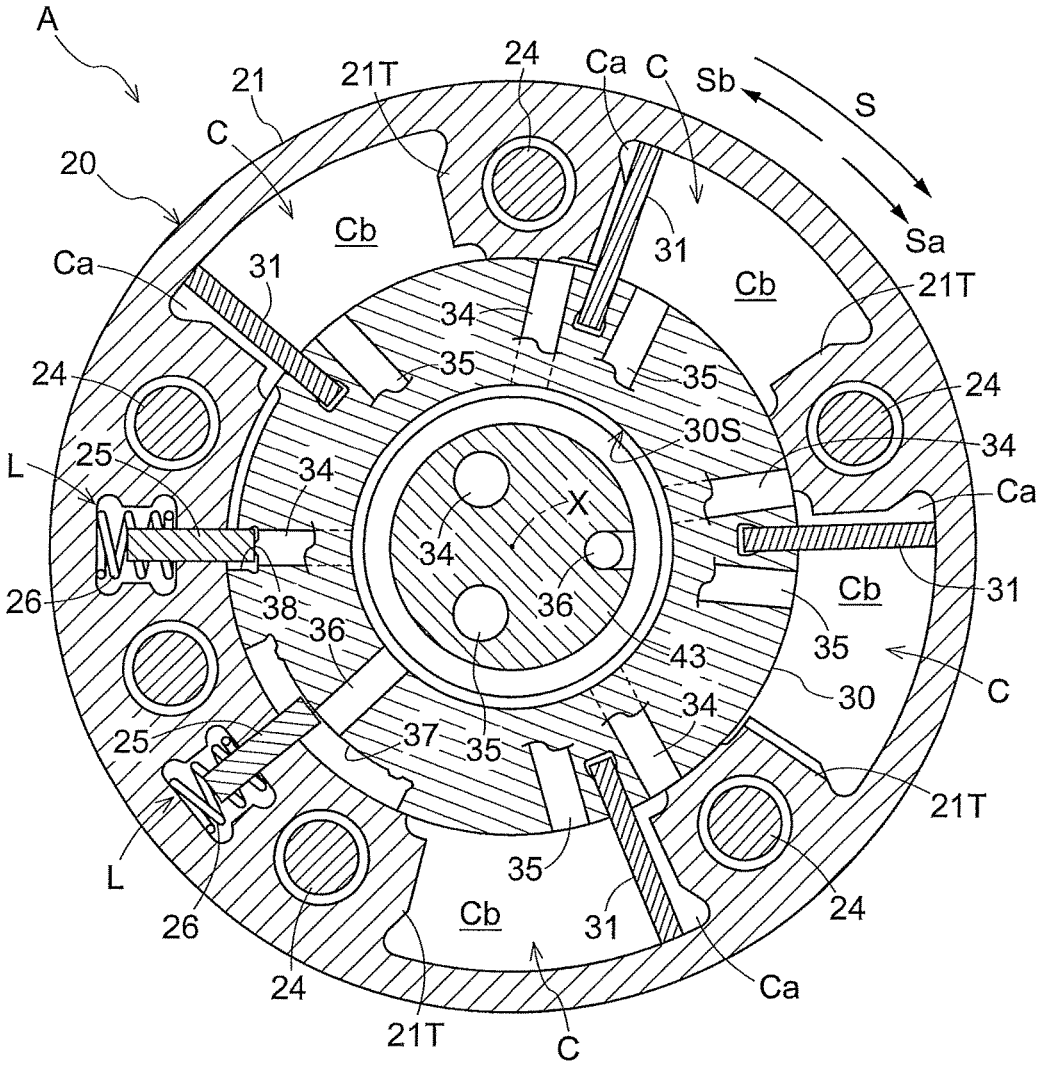
FIG. 4 is a cross-sectional view of the valve opening/closing timing control apparatus when it is in a maximum retard locked phase.
FIG. 5 is a diagram showing supply/discharge patterns of hydraulic oil with respect to the position of the control valve.

As shown in FIG. 2, in the intermediate locked phase, the pair of locking members 25 are fitted into the intermediate locking recess portion 37 and respectively abut the circumferential end faces of the intermediate locking recess portion 37. In the intermediate locked phase, when hydraulic oil is supplied to the lock releasing flow path 36, as shown in FIG. 3, the two locking members 25 are moved against the biasing force of the locking springs 26 in a direction of being spaced apart from the rotation axis X to release the engagement (release the locked state). In the maximum retard locked phase, as shown in FIG. 4, one of the locking members 25 is engaged with the maximum retard locking recess portion 38, hydraulic oil is supplied to the advance flow path 34, and thereby the locking member 25 is moved against the biasing force of the locking spring 26 in a direction of being spaced apart from the rotation axis to release the engagement (release the locked state). After the locked state has been released, the relative rotation phase is displaced in an advance direction Sa.

A relative rotation phase in which each vane 31 reaches a moving end in the advance direction Sa (a limit of pivotal movement about the rotation axis X) is referred to as "maximum advance phase", and a relative rotation phase in which each vane 31 reaches a retard-side moving end (a limit of pivotal movement about the rotation axis X) is referred to as "maximum retard phase".

The intermediate locked phase is a phase that optimally maintains the valve opening/closing timing when the engine E in a cold state is activated. At the time of deactivation of the engine E, the relative rotation phase is displaced to the intermediate locked phase so as to cause transition to the locked state established by the locking mechanism L. After that, control is performed to deactivate the engine E. The maximum retard locked phase is a phase that reduces the activation load of the engine E. For example, when it is highly likely that the engine will be re-activated in a warm-up state, as with an idle stop, the relative rotation phase is displaced to the maximum retard locked phase so as to cause transition to the locked state established by the locking mechanism L. After that, control is performed to deactivate the engine E.

A torsion spring 27 is provided so as to extend between the rear block 22 of the outer rotor 20 and the inner rotor 30. The torsion spring 27 exerts a biasing force that displaces the relative rotation phase from the maximum retard locked phase to a position close to the intermediate locked phase.

In the valve opening/closing timing control apparatus A, the outer rotor 20 rotates in a driving rotary direction S by a driving force transmitted from the timing chain 6. Also, the relative rotation phase is displaced in the advance direction Sa by supplying the hydraulic oil to the advance chamber Ca, and the relative rotation phase is displaced in the retard direction Sb by supplying the hydraulic oil to the retard chamber Cb.

A direction in which the inner rotor 30 rotates with respect to the outer rotor 20 in the same direction as the driving rotary direction S is referred to as the advance direction Sa, and a rotation direction opposite thereto is referred to as the retard direction Sb. In the valve opening/closing timing control apparatus A, the intake timing is advanced as the relative rotation phase is displaced farther in the advance direction Sa, and the intake timing is delayed as the relative rotation phase is displaced farther in the retard direction Sb.

Control Valve

Figure 6:
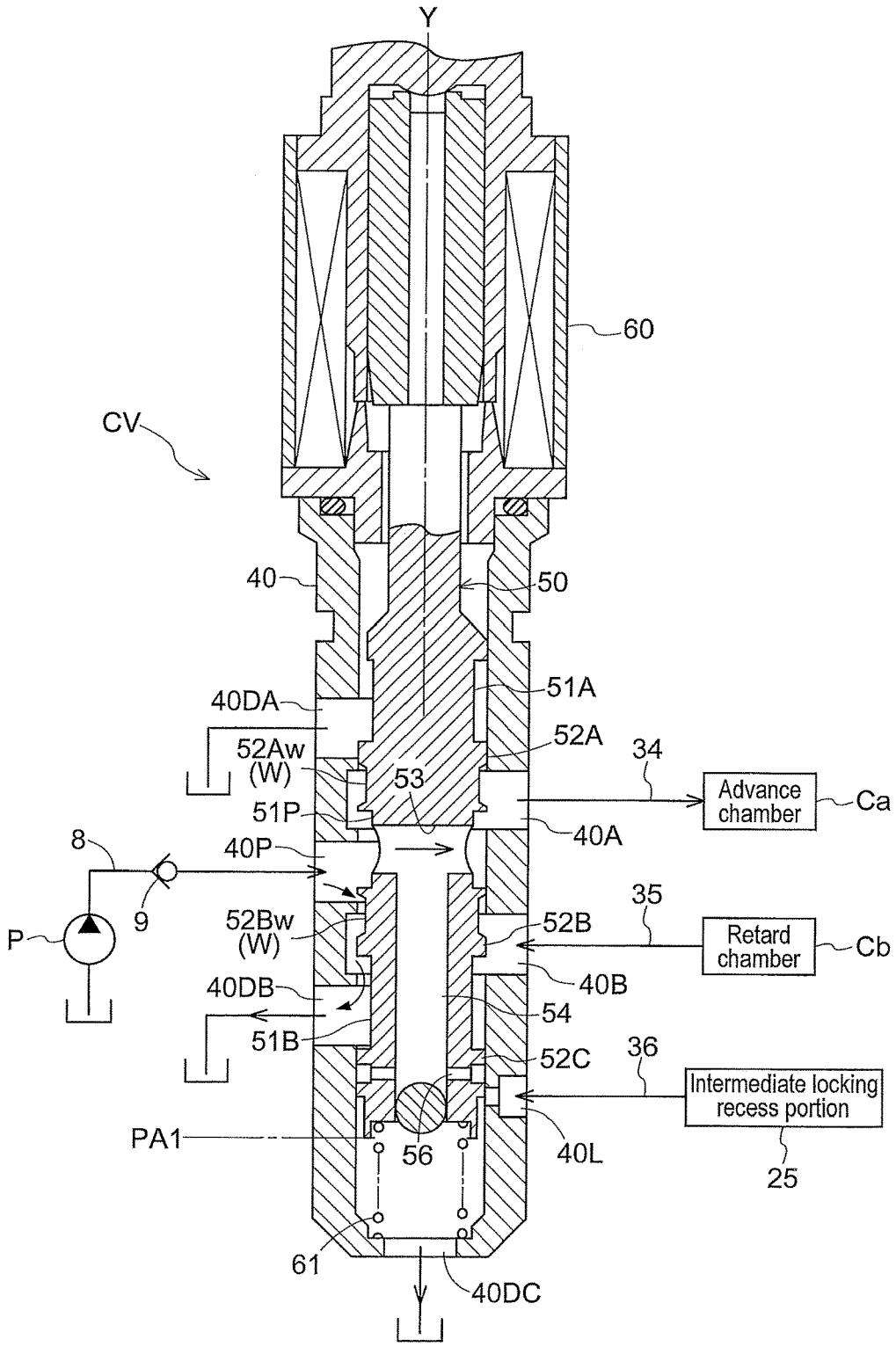
FIG. 6 is a cross-sectional view of the control valve when a spool is positioned in a first advance position.

As shown in FIGS. 1 and 6, the control valve CV includes a valve case 40, a spool 50, an electromagnetic solenoid 60 and a spool spring 61. The spool 50 is housed in a spool housing space of the valve case 40 so as to be capable of moving along a spool axis Y (a specific example of the axis of the spool 50). The electromagnetic solenoid 60 exerts an operating force on the spool 50 in a direction against the biasing force of the spool spring 61. The present embodiment will be described assuming that the control valve CV is disposed on top of the valve case 40.

The shaft-like portion 41 formed in the valve case 40 is inserted into the inner rotor 30, and the valve case 40 is thereby supported by the engine E via a bracket or the like. As described above, in the shaft-like portion 41, a plurality of columnar flow paths that are coaxial with the rotation axis X and are capable of supplying and discharging the fluid are formed. Also, a plurality of ring-shaped gaskets 42 are provided between the outer circumference of the shaft-like portion 41 and the inner circumferential surface 30S of the inner rotor 30 such that the hydraulic oil can be supplied and discharged when the valve opening/closing timing control apparatus A rotates about the rotation axis X.

The valve case 40 includes a pump port 40P, an advance port 40A, a retard port 40B, a lock releasing port 40L, a first drain port 40DA (an example of the phase controlling drain port), a second drain port 40DB (an example of the phase controlling drain port), and a third drain port 40DC (an example of the lock releasing drain port). In the present embodiment, the first drain port 40DA is disposed in the position closest to the electromagnetic solenoid 60 in a direction extending along the spool axis Y Subsequently, the advance port 40A, the pump port 40P, the retard port 40B, the second drain port 40DB, the lock releasing port 40L and the third drain port 40DC are disposed in this order in a direction of moving away from the electromagnetic solenoid 60. The third drain port 40DC is disposed at a bottom portion of the valve case 40.

The pump port 40P is in communication with the oil pressure pump P via the supply flow path 8. The advance port 40A is in communication with the advance chamber Ca via the advance flow path 34. The retard port 40B is in communication with the retard chamber Cb via the retard flow path 35. The lock releasing port 40L is in communication with the intermediate locking recess portion 37, which is a lock releasing space for the locking members 25, via the lock releasing flow path 36.

In the spool 50, a pump-side groove portion 51P having a small diameter is formed at a central position in the direction of the spool axis Y, a first groove portion 51A for drainage having a small diameter is formed above the pump-side groove portion 51P (on the electromagnetic solenoid side), and a second groove portion 51B for drainage having a small diameter is formed below the pump-side groove portion 51P.

A first land portion 52A is formed above the pump-side groove portion 51P, and a second land portion 52B is formed below the pump-side groove portion 51P. A third land portion 52C is formed below the second groove portion 51B. The outer diameter of the first land portion 52A, the second land portion 52B and the third land portion 52C is set to a value so as to be in proximity to the spool housing space of the valve case 40.

In the pump-side groove portion 51P, a single phase control flow path 53 is formed so as to be perpendicular to the spool axis Y, and a lock control flow path 54 that branches off in the direction extending along the spool axis Y from a central position of the phase control flow path 53 is formed within the spool 50. The phase control flow path 53 allows supply of hydraulic oil to the advance port 40A and the retard port 40B. Likewise, the lock control flow path 54 allows supply of hydraulic oil to the lock releasing port 40L.

A lock operation flow path 56 is formed so as to be perpendicular to the spool axis Y and to communicate with the outer circumferential portion of the third land portion 52C, and the lock operation flow path 56 is in communication with the lock control flow path 54.

Communication Path

In the control valve CV, particularly when the spool 50 is operated to be in a first advance position PA1 (an example of the lock transition positions) and when the spool 50 is operated to be in a first retard position PB1 (an example of the lock transition positions), a portion of the hydraulic oil is discharged so as to reduce the speed of displacement of the relative rotation phase, and thereby a communication path W that reliably causes transition to the locked state established by the locking mechanism L is formed.

In the valve case 40, the inner circumference of a region opposite to the advance port 40A across the spool axis Y has been processed to be enlarged. Also, part of the outer circumference of the first land portion 52A outer circumference has been processed to have a small diameter, and a first reduced diameter portion 52Aw is thereby formed. Likewise, the inner circumference of a region opposite to the retard port 40B across the spool axis Y has been processed to be enlarged. Also, part of the outer circumference of the second land portion 52B has been processed to have a small diameter, and a second reduced diameter portion 52Bw is thereby formed. The first reduced diameter portion 52Aw and the second reduced diameter portion 52Bw together constitute the communication path W according to the present disclosure.

When the spool 50 is operated to be in the first advance position PA1, the second reduced diameter portion 52Bw is in a position shown in FIG. 6, and the communication path W is configured such that a portion of the hydraulic oil supplied from the pump port 40P to the advance port 40A can be discharged from the second reduced diameter portion 52Bw, which is the communication path W, to the second drain port 40DB.

Figure 10:
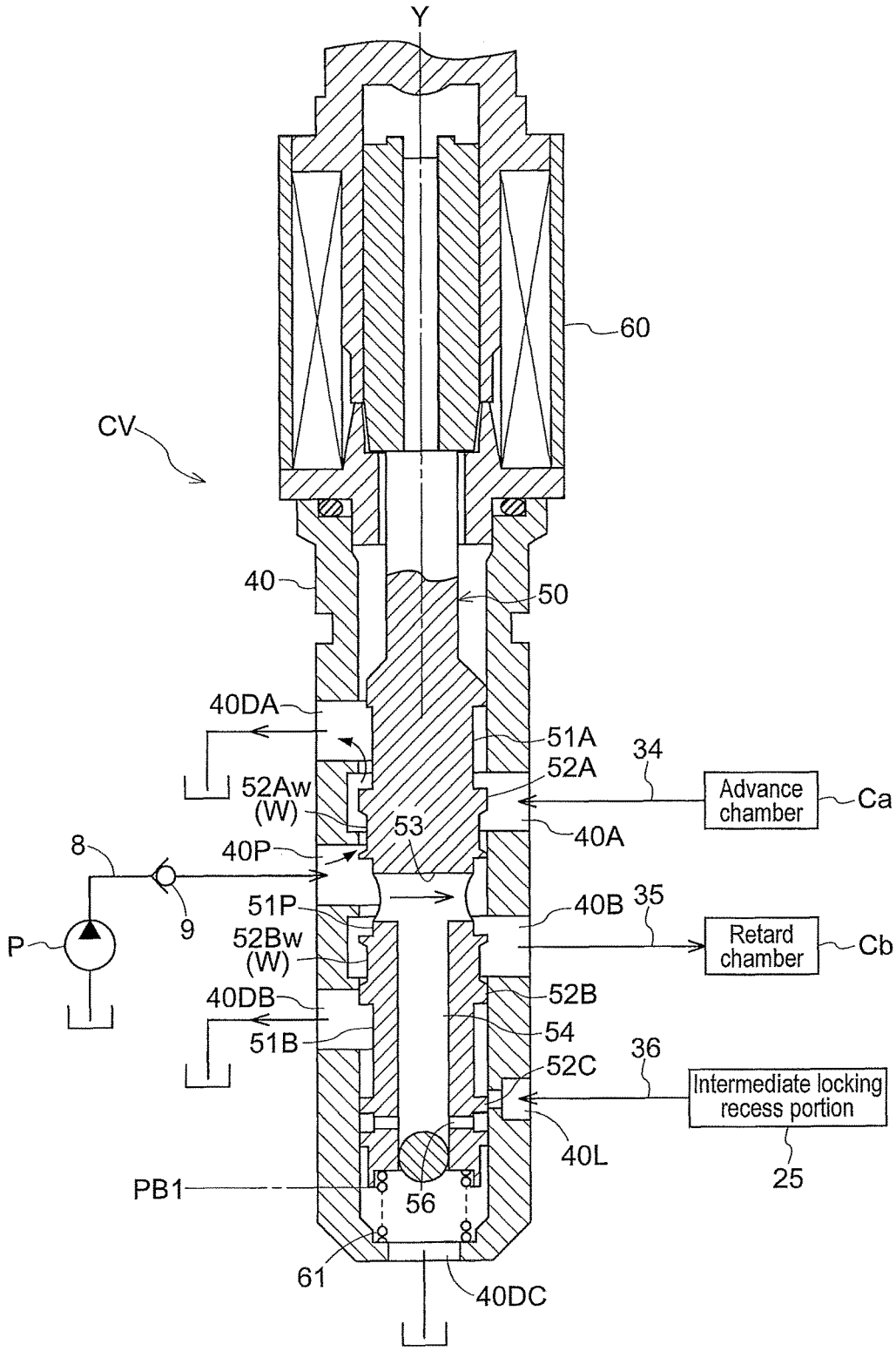
FIG. 10 is a cross-sectional view of the control valve when the spool is positioned in a first retard position.

When the spool 50 is operated to be in the first retard position PB1, the first reduced diameter portion 52Aw is in a position shown in FIG. 10, and the communication path W is configured such that a portion of the hydraulic oil supplied from the pump port 40P to the retard port 40B can be discharged from the first reduced diameter portion 52Aw, which is the communication path W, to the first drain port 40DA. That is, the first drain port 40DA serves also as a drain port through which the hydraulic oil from the retard port 40B is discharged.

The cross-sectional flow area of the communication path W is set to be smaller than the cross-sectional flow area of the phase control flow path 53, the advance port 40A and the retard port 40B.

Overview of Operating Configuration of Control Valve

As specific operating positions of the spool 50 of the control valve CV according to the present embodiment, as shown in FIGS. 6 to 10, the spool 50 is configured to be operated to be in the following five positions: a first advance position PA1, a second advance position PA2, a lock releasing position PL, a second retard position PB2, and a first retard position PB1. Supply/discharge patterns with respect to these positions are shown in FIG. 5.

In this configuration, the second advance position PA2, the lock releasing position PL and the second retard position PB2 are phase control positions in which supply and discharge of hydraulic oil to and from the advance port 40A and the retard port 40B is controlled while the fluid is supplied to the lock releasing port 40L. The first advance position PA1 and the first retard position PB1 are lock transition positions in which supply and discharge of hydraulic oil to and from one of the advance port 40A and the retard port 40B is controlled while the hydraulic oil is discharged from the lock releasing port 40L.

In the control valve CV, when power is not supplied to the electromagnetic solenoid 60, the spool 50 is positioned at the first advance position PA1. The spool 50 is switched to the second advance position PA2, the lock releasing position PL, the second retard position PB2, and the first retard position PB1 in this order by increasing the power supplied to the electromagnetic solenoid 60 by a predetermined value.

Particularly in the case of adjusting the opening/closing timing of the intake valve Va while the engine E is running, the spool 50 is controlled to be in any one of the lock releasing position PL, the second retard position PB2, and the second advance position PA2, and thus the spool 50 is not operated to be in the first advance position PA1 or the first retard position PB1.

First Advance Position

When power is not supplied to the electromagnetic solenoid 60, the spool 50 is positioned in the first advance position PA1 shown in FIG. 6. In this position, due to the positional relationship between the first land portion 52A and the advance port 40A, the hydraulic oil supplied to the pump port 40P is supplied to the advance port 40A via the phase control flow path 53 and the pump-side groove portion 51P. Also, due to the positional relationship between the second land portion 52B and the retard port 40B, the hydraulic oil from the retard port 40B is discharged to the second drain port 40DB via the second groove portion 51B.

In the first advance position PA1, a portion of the hydraulic oil flowing from the pump port 40P to the phase control flow path 53 is discharged to the second drain port 40DB via the communication path W (the second reduced diameter portion 52Bw). The discharge of hydraulic oil through the communication path W causes the relative rotation phase to be displaced in the advance direction Sa at a low speed, and thus the transition to the locked state established by the locking mechanism L can be reliably performed.

That is, because the relative rotation phase is displaced in the advance direction Sa at a low speed, when the relative rotation phase reaches the intermediate locked phase, the pair of locking members 25 are engaged with the intermediate locking recess portion 37 due to the biasing force of the locking spring 26, and thus the transition to the locked state can be achieved in the intermediate locked phase.

Second Advance Position

Figure 7:
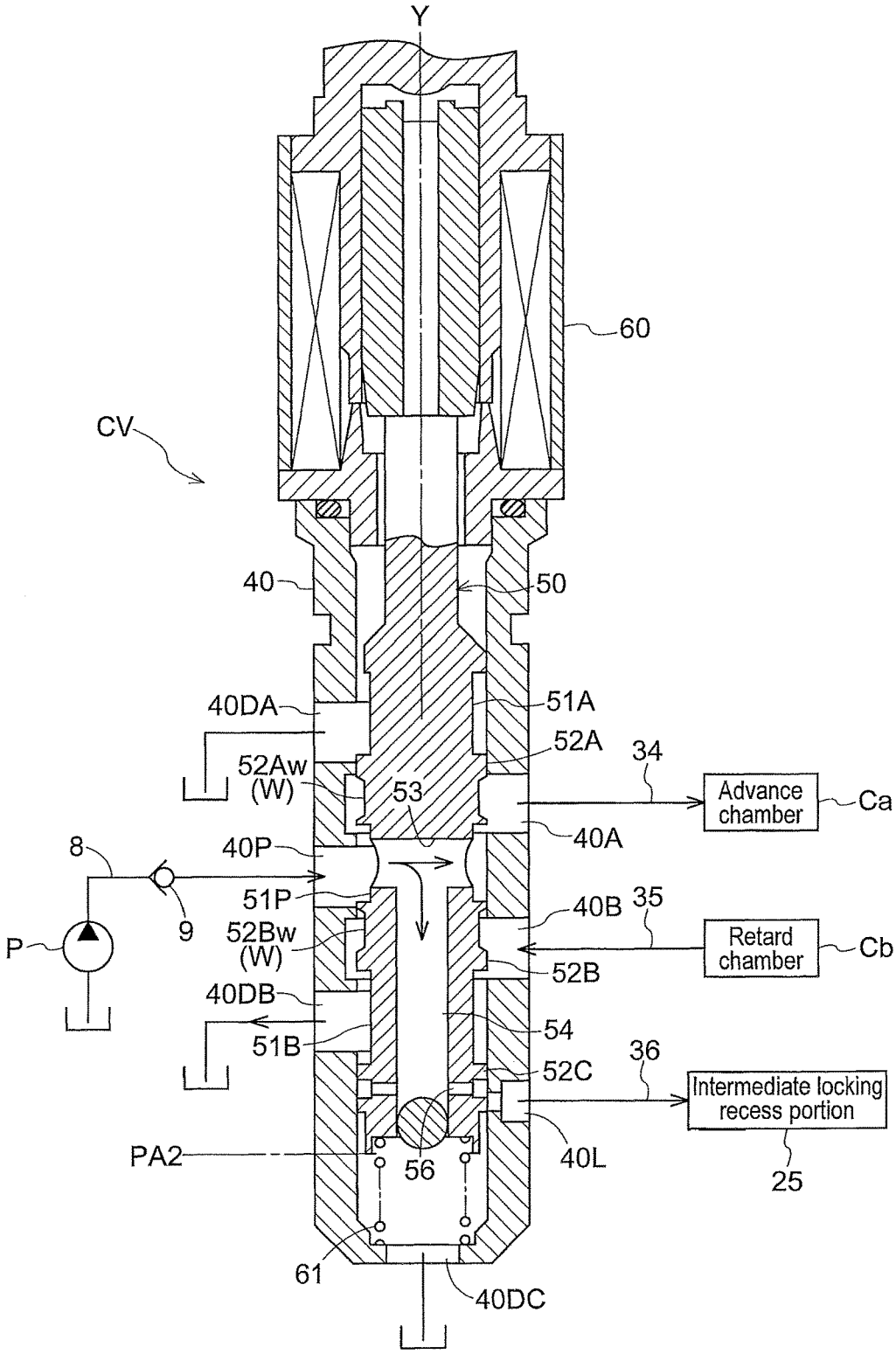
FIG. 7 is a cross-sectional view of the control valve when the spool is positioned in a second advance position.

In the second advance position PA2 shown in FIG. 7, due to the positional relationship between the first land portion 52A and the advance port 40A, as in the first advance position PA1, the hydraulic oil supplied to the pump port 40P is supplied to the advance port 40A via the phase control flow path 53 and the pump-side groove portion 51P. Also, due to the positional relationship between the second land portion 52B and the retard port 40B, the hydraulic oil from the retard port 40B is discharged to the second drain port 40DB via the second groove portion 51B.

Furthermore, in the second advance position PA2, because the lock operation flow path 56 is in a positional relationship in which it is in communication with the lock releasing port 40L, hydraulic oil pressure acts on the lock control flow path 54 branching off from the phase control flow path 53, and as a result the hydraulic oil is supplied to the lock releasing port 40L.

Consequently, the relative rotation phase is displaced in the advance direction Sa. Also, when the relative rotation phase is in the intermediate locked phase, the hydraulic oil from the lock releasing port 40L acts on the pair of locking members 25 through the lock releasing flow path 36, which shifts the locking members 25 against the locking springs 26 to release the locked state established by the locking mechanism L. As a result, a lock released state is maintained.

Lock Releasing Position

Figure 8:
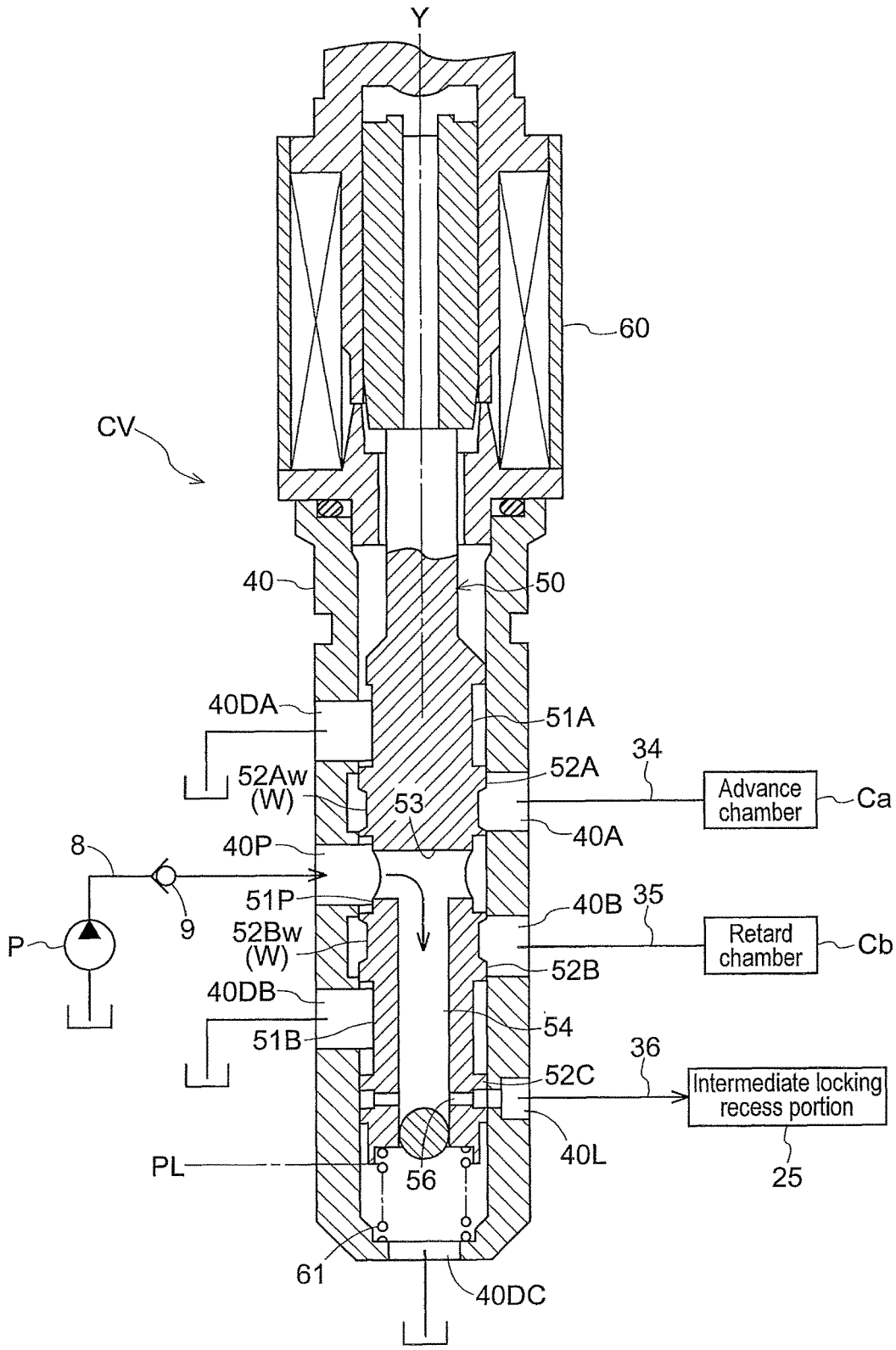
FIG. 8 is a cross-sectional view of the control valve when the spool is positioned in a lock releasing position.

In the lock releasing position PL shown in FIG. 8, the first land portion 52A is positioned so as to close the advance port 40A, and the second land portion 52B is positioned so as to close the retard port 40B. At the same time, the lock operation flow path 56 is positioned so as to communicate with the lock releasing port 40L. That is, the flow of hydraulic oil to the advance port 40A and the retard port 40B is blocked, causing hydraulic oil pressure to act on the lock control flow path 54 branching off from the phase control flow path 53, and the hydraulic oil is supplied to the lock releasing port 40L.

Consequently, when the relative rotation phase is in the intermediate locked phase, the locking members 25 are shifted against the locking springs 26, and a state in which the locked state established by the locking mechanism L is released is maintained.

Second Retard Position

Figure 9:
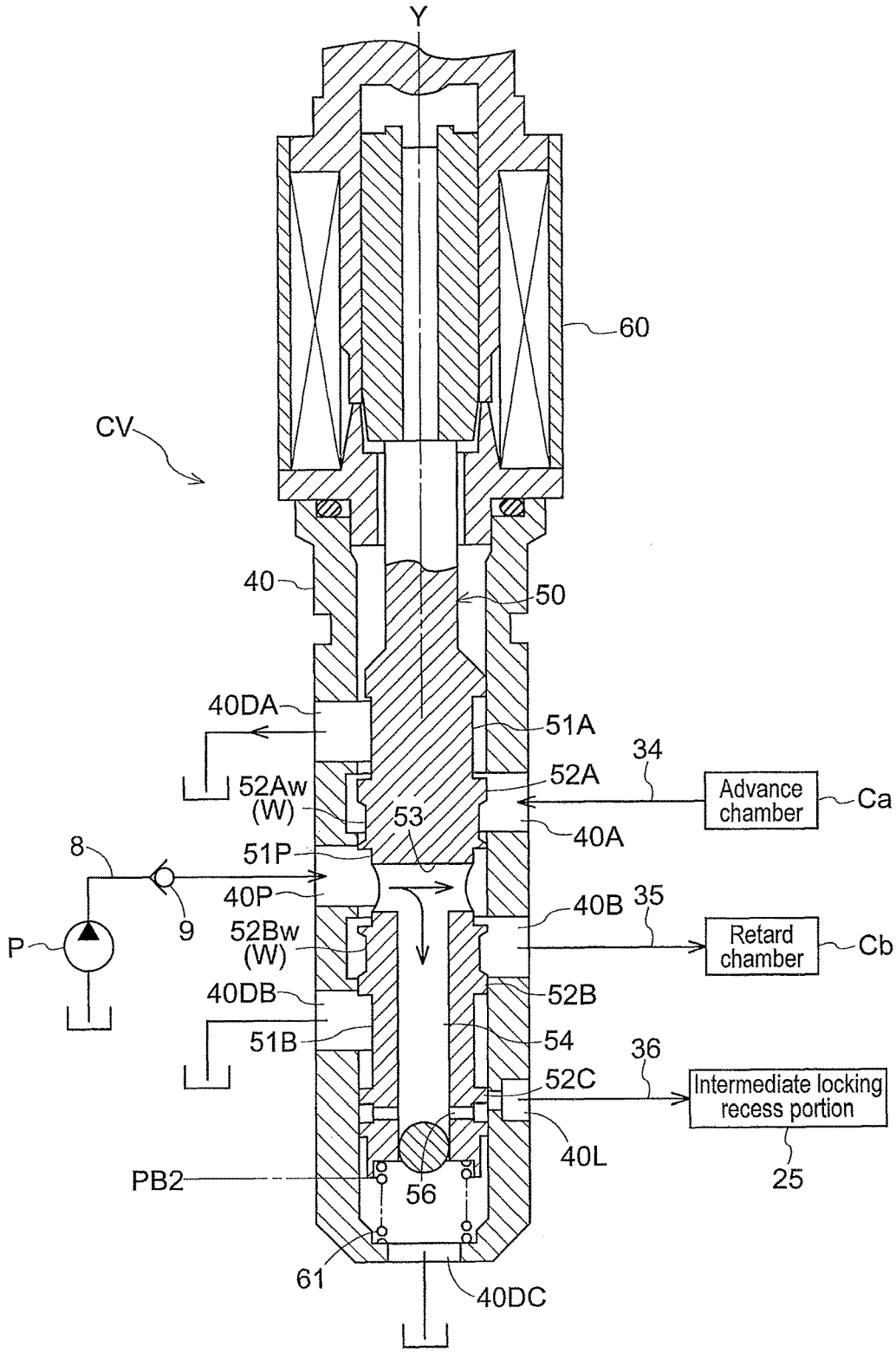
FIG. 9 is a cross-sectional view of the control valve when the spool is positioned in a second retard position.

In the second retard position PB2 shown in FIG. 9, due to the positional relationship between the second land portion 52B and the retard port 40B, the hydraulic oil supplied to the pump port 40P is supplied to the retard port 40B via the phase control flow path 53. Also, due to the positional relationship between the first land portion 52A and the advance port 40A, the hydraulic oil from the advance port 40A is discharged to the first drain port 40DA via the first groove portion 51A.

Furthermore, in the second retard position PB2, because the lock operation flow path 56 is in a positional relationship in which it is in communication with the lock releasing port 40L, hydraulic oil pressure acts on the lock control flow path 54 branching off from the phase control flow path 53, and as a result the hydraulic oil is supplied to the lock releasing port 40L.

Consequently, the relative rotation phase is displaced in the retard direction Sb. Also, when the relative rotation phase is in the intermediate locked phase, the hydraulic oil from the lock releasing port 40L acts on the pair of locking members 25 through the lock releasing flow path 36, which shifts the locking members 25 against the locking springs 26 to release the locked state established by the locking mechanism L. As a result, a lock released state is maintained.

First Retard Position

In the first retard position PB1 shown in FIG. 10, due to the positional relationship between the second land portion 52B and the retard port 40B, as in the first retard position PB1, the hydraulic oil supplied to the pump port 40P is supplied to the retard port 40B via the phase control flow path 53 and the pump-side groove portion 51P. Also, due to the positional relationship between the first land portion 52A and the advance port 40A, the hydraulic oil from the advance port 40A is discharged to the first drain port 40DA via the first groove portion 51A. Furthermore, the hydraulic oil from the lock releasing port 40L is discharged to the second drain port 40DB.

In the first retard position PB1, a portion of the hydraulic oil flowing from the pump port 40P to the phase control flow path 53 is discharged to the first drain port 40DA via the communication path W (the first reduced diameter portion 52Aw). The discharge of hydraulic oil through the communication path W causes the relative rotation phase to be displaced in the retard direction Sb at a low speed, and thus the transition to the locked state established by the locking mechanism L can be reliably performed.

That is, because the relative rotation phase is displaced in the retard direction Sb at a low speed, when the relative rotation phase reaches the intermediate locked phase, the pair of locking members 25 are engaged with the intermediate locking recess portion 37 due to the biasing force of the locking spring 26. When the relative rotation phase reaches the maximum retard locked phase, one of the locking members 25 engages with the maximum retard locking recess portion 38, and the transition to the locked state can be achieved.

Locking Operation

At the time of deactivation of the engine E, the relative rotation phase is displaced to the intermediate locked phase, and control is executed to cause transition to the locked state established by the locking mechanism L.

Transition from Retard-Side to Intermediate Locked Phase

In the case where control is performed to cause the relative rotation phase to transition to the intermediate locked phase from a state in which the spool 50 is positioned in the lock releasing position PL and the relative rotation phase is in a position on the retard side with respect to the locked phase, the control valve CV is operated to be in the first advance position PA1 from the lock releasing position PL. As a result of this operation, the hydraulic oil pressure and the relative rotation phase of the valve opening/closing timing control apparatus A are displaced as shown in a chart on the left side of FIG. 11.

In the diagram, the term "advance hydraulic oil pressure" refers to the pressure in a region extending from the advance port 40A to the advance chamber Ca, but here it is described as the pressure of the advance port 40A. The term "retard hydraulic oil pressure" refers to the pressure in a region extending from the retard port 40B to the retard chamber Cb, but here it is described as the pressure of the retard port 40B. The term "lock releasing hydraulic oil pressure" refers to the pressure in a region extending from the lock releasing port 40L to the intermediate locking recess portion 37, but here it is described as the pressure of the lock releasing port 40L.

That is, because the hydraulic oil is contained in the advance chamber Ca at the early stage of this operation, the pressure of the advance port 40A takes a high value. When the control valve CV is operated to be in the first advance position PA1 and the displacement of the relative rotation phase starts, the pressure of the advance port 40A temporarily drops due to the increase in volume of the advance chamber Ca. During this pressure drop, a portion of the hydraulic oil supplied to the advance port 40A is discharged from the communication path W (the second reduced diameter portion 52Bw), and thus the pressure of the advance port 40A is maintained at a low value. In a configuration in which the communication path W is not formed, the pressure of the advance port 40A is maintained at a relatively high value as indicated by an imaginary line.

When the control valve CV is operated to be in the first advance position PA1, the hydraulic oil of the retard chamber Cb is discharged to the second drain port 40DB. In this case, in a configuration in which the communication path W is not formed, the pressure drops to zero as indicated by an imaginary line. However, a portion of the fluid from the pump port 40P is discharged to the second drain port 40DB via the communication path W, and thus the pressure of the retard port 40B does not drop to zero and is maintained at a value slightly higher than zero.

When the control valve CV is operated to be in the first advance position PA1, the hydraulic oil of the intermediate locking recess portion 37 is discharged from the lock releasing port 40L to the third drain port 40DC. During the discharge of the hydraulic oil, flow path resistance acts, and thus the pressure of the lock releasing port 40L drops as indicated in the diagram.

When the control valve CV is operated as described above, the relative rotation phase starts to be displaced in a direction toward the intermediate locked phase from the retard side. Because a portion of the hydraulic oil supplied from the advance port 40A to the advance chamber Ca is discharged to the second drain port 40DB through the communication path W as described above, the speed of displacement of the relative rotation phase decelerates. In a configuration in which the communication path W is not formed, the speed of displacement of the relative rotation phase increases with a gradient indicated by an imaginary line in the diagram. When the relative rotation phase reaches the intermediate locked phase, the lock releasing oil pressure drops to zero.

In this configuration, the pressure of the retard port 40B takes a value higher than zero, and thus the resistance when the hydraulic oil is discharged from the retard port 40B increases. This also reduces the speed of displacement when the relative rotation phase is displaced in the advance direction Sa.

Consequently, while the displacement of the relative rotation phase is decelerated, one of the locking members 25 is first engaged into the intermediate locking recess portion 37 due to the biasing force of the locking spring 26. After that, when the relative rotation phase reaches the intermediate locked phase, the lock releasing oil pressure drops to zero, and the other locking member 25 is engaged into the intermediate locking recess portion 37 in the zero pressure state due to the biasing force of the locking spring 26, as a result of which the transition to the intermediate locked state can be reliably performed.

Transition from Advance-Side to Intermediate Locked Phase

In the case where control is performed to cause the relative rotation phase to transition to the intermediate locked phase from a state in which the spool 50 is positioned in the lock releasing position PL and the relative rotation phase is in a position on the advance side with respect to the locked state, the control valve CV is operated to be in the first retard position PB1 from the lock releasing position PL. As a result of this operation, the hydraulic oil pressure and the relative rotation phase of the valve opening/closing timing control apparatus A are displaced as shown in a chart on the right side of FIG. 11.

With this control, the direction of displacement of the relative rotation phase is opposite to that when the relative rotation phase is transitioned from the retard-side to the intermediate locked phase described above, and thus "advance hydraulic oil pressure" and "retard hydraulic oil pressure" are displaced accordingly.

That is, because the hydraulic oil is contained in the retard chamber Cb at the early stage of this operation, the pressure of the retard port 40B takes a high value. When the control valve CV is operated to be in the first retard position PB1 and the displacement of the relative rotation phase starts, the pressure of the retard port 40B temporarily drops due to the increase in volume of the retard chamber Cb. During this pressure drop, a portion of the hydraulic oil supplied to the retard port 40B is discharged from the communication path W (the first reduced diameter portion 52Aw), and thus the pressure of the retard port 40B is maintained at a low value. In a configuration in which the communication path W is not formed, the pressure of the retard port 40B is maintained at a relatively high value as indicated by an imaginary line.

When the control valve CV is operated to be in the first retard position PB1, the hydraulic oil of the advance chamber Ca is discharged to the first drain port 40DA. In this case, in a configuration in which the communication path W is not formed, the pressure drops to zero as indicated by an imaginary line. However, a portion of the fluid from the pump port 40P is discharged to the first drain port 40DA via the communication path W, and thus the pressure of the advance port 40A does not drop to zero and is maintained at a value slightly higher than zero.

When the control valve CV is operated to be in the first retard position PB1, the hydraulic oil of the intermediate locking recess portion 37 is discharged from the lock releasing port 40L to the second drain port 40DB. During the discharge of the hydraulic oil, flow path resistance acts, and thus the pressure of the lock releasing port 40L drops as indicated in the diagram.

When the control valve CV is operated as described above, the relative rotation phase starts to be displaced in a direction toward the intermediate locked phase from the advance side. Because a portion of the hydraulic oil supplied from the retard port 40B to the retard chamber Cb is discharged to the first drain port 40DA through the communication path W as described above, the speed of displacement of the relative rotation phase decreases, and the transition to the locked state is reliably performed. In a configuration in which the communication path W is not formed, the speed of displacement of the relative rotation phase increases with a gradient indicated by an imaginary line in the diagram. When the relative rotation phase reaches the intermediate locked phase, the lock releasing oil pressure drops to zero.

In this configuration, the pressure of the advance port 40A takes a value higher than zero, and thus the resistance when the hydraulic oil is discharged from the advance port 40A increases. This also reduces the speed of displacement when the relative rotation phase is displaced in the retard direction Sb.

Consequently, while the displacement of the relative rotation phase is decelerated, one of the locking members 25 is first engaged into the intermediate locking recess portion 37 due to the biasing force of the locking spring 26. After that, when the relative rotation phase reaches the intermediate locked phase, the lock releasing oil pressure drops to zero, and the other locking member 25 is engaged into the intermediate locking recess portion 37 in the zero pressure state due to the biasing force of the locking spring 26, as a result of which the transition to the intermediate locked state can be reliably performed.

Transition to Locked State During Activation of Engine

The engine E may stall by overload, and a situation may occur in which control for transition to the locked state established by the locking mechanism L is not performed appropriately even when the relative rotation phase is displaced to the intermediate locked phase to deactivate the engine E as described above. When the engine E is deactivated while the valve opening/closing timing control apparatus A is not in the locked state as described above, and the engine E is thereafter activated, control is performed to cause the relative rotation phase of the valve opening/closing timing control apparatus A to transition to the intermediate locked phase so as to cause the locking mechanism L to transition to the locked state.

With this control as well, the spool 50 is operated to be in the first advance position PA1 or the first retard position PB1, and thus the speed of displacement of the relative rotation phase is reduced with the use of the communication path W, and a reliable transition to the locked state is implemented.

Particularly when the engine E is deactivated, power is not supplied to the electromagnetic solenoid 60, and thus the spool 50 of the control valve CV is positioned in the first advance position PA1. Also, the retard port 40B communicates with the second drain port 40DB, and the pump port 40P and the advance port 40A communicate with each other via the phase control flow path 53.

Consequently, the hydraulic oil of the retard chamber Cb is discharged to the second drain port 40DB via the communication path W, and the hydraulic oil of the advance chamber Ca is discharged to the second drain port 40DB. As a result of the hydraulic oil contained in the advance chamber Ca and the retard chamber Cb being discharged in this way, the hydraulic oil does not remain in the advance chamber Ca and the retard chamber Cb.

Furthermore, when the spool 50 is set to be in the first advance position PA1 or the first retard position PB1, the advance chamber Ca and the retard chamber Cb communicate with each other. Accordingly, at the time when the starter motor is driven to activate the engine E while the locking mechanism L is not in the locked state, by setting the spool 50 to be in the first advance position PA1 or the first retard position PB1, it is possible to rapidly discharge hydraulic oil from the advance chamber Ca and the retard chamber Cb due to varying torque exerted from the intake camshaft 7 and cause the locking mechanism L to rapidly transition to the locked state.

A specific operating configuration is as follows: an operation is repeated in which, when the volume of one of the advance chamber Ca and the retard chamber Cb increases, the volume of the other chamber decreases as with respiration by the action of varying torque from the intake camshaft 7 upon activation of the starter motor, and the discharge of hydraulic oil is thereby performed. It is thereby possible to cause pressure to act on the hydraulic oil remaining in the advance chamber Ca and the retard chamber Cb and reliably discharge the hydraulic oil. With this configuration, with the resistance of hydraulic oil being eliminated, the relative rotation phase can be rapidly displaced to the locked phase to enable the transition to the locked state to be performed, as compared with the case where, for example, the relative rotation phase is displaced to the intermediate locked phase while the hydraulic oil remains in the advance chamber Ca or the retard chamber Cb.

In particular, with this configuration, even in a situation in which the viscosity of hydraulic oil increases due to a decrease in temperature, by forcibly ejecting the hydraulic oil at the time of activation of the engine E, the time required to displace the relative rotation phase can be shortened, and the transition to the locked state can be performed rapidly.

Variation of Control Valve

In the present embodiment, the advance port 40A is disposed on an upper side, and the retard port 40B is disposed below the advance port 40A. However, instead of this configuration, the retard port 40B may be disposed on an upper side, and the advance port 40A may be disposed below the retard port 40B without changing the configuration of the control valve CV.

That is, the control valve CV may be configured such that the spool 50 is positioned in the first retard position PB1 when power is not supplied to the electromagnetic solenoid 60, and the position is switched to the second retard position PB2, the lock releasing position PL, the second advance position PA2 and the first advance position PA1 in this order by increasing power.

According to the present variation as well, a portion of the hydraulic oil supplied from the pump port 40P can be discharged to the drain port (for example, the second drain port 40DB) through the communication path W, and the transition to the locked state of the locking mechanism L can be reliably performed by deceleration of the relative rotation phase.

Variations of First Embodiment

Variation (a)

The present disclosure may include one of the following configurations: in which a portion of the hydraulic oil supplied to the advance port 40A is discharged to the communication path W when the spool 50 is operated to be in the first advance position PA1; and in which a portion of the hydraulic oil supplied to the retard port 40B is discharged to the communication path W when the spool 50 is operated to be in the first retard position PB1.

The configuration according to Variation (a) can also be applied to the control valve CV described under [Variation of Control Valve] in which the spool 50 is operated to be in the first retard position PB1 when power is not supplied to the electromagnetic solenoid 60.

Variation (b)

Figures 11, 12:
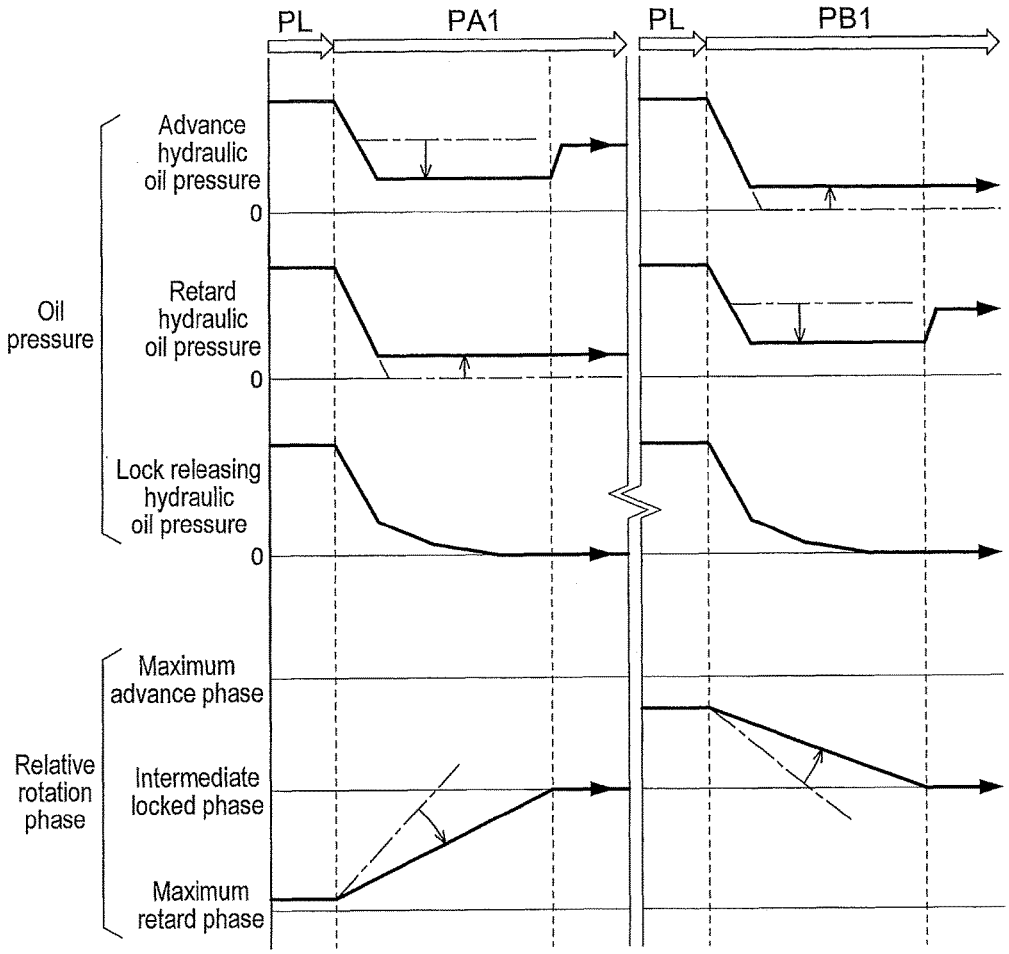
FIG. 11 is a chart showing hydraulic oil pressure and the like when the spool is operated from the lock releasing position to the first advance position or the second advance position.
FIG. 12 is a diagram showing supply/discharge patterns of hydraulic oil with respect to the position of a control valve according to Variation (b) of the first embodiment.

The supply/discharge patterns of hydraulic oil when the spool 50 is operated to be in the following five positions: the first advance position PA1, the second advance position PA2, the lock releasing position PL, the second retard position PB2, and the first retard position PB1 may be set as shown in FIG. 12.

According to the supply/discharge patterns, when the spool 50 is displaced in a direction toward the second advance position PA2 from the first advance position PA1, the communication path W is closed before the spool 50 reaches the second advance position PA2. When the spool 50 is displaced in a direction toward the second retard position PB2 from the first retard position PB1, the communication path W is closed before the spool 50 reaches the second retard position PB2.

That is, the first advance position PA1 (lock transition position) in which hydraulic oil is supplied to the advance port 40A is disposed in a position adjacent to the second advance position PA2 (phase control position) in which hydraulic oil is supplied to the advance port 40A, and the first retard position PB1 (lock transition position) in which hydraulic oil is supplied to the retard port 40B is disposed in a position adjacent to the second retard position PB2 (phase control position) in which hydraulic oil is supplied to the retard port 40B. Also, the communication path W is configured to be closed in a region of the lock transition position, the region being adjacent to the phase control position.

Consequently, for example, even if the spool 50 overshoots and reaches the end of the first advance position PA1 while the spool 50 is operated from the second retard position PB2 to the second advance position PA2, a portion of the hydraulic oil supplied to the phase control flow path 53 is not discharged to the communication path W, and thus the speed of displacement of the relative rotation phase is not reduced. Likewise, even if the spool 50 overshoots and reaches the end of the first retard position PB1 while the spool 50 is operated from the second advance position PA2 to the second retard position PB2, a portion of the hydraulic oil supplied to the phase control flow path 53 is not discharged to the communication path W, and thus the speed of displacement of the relative rotation phase is not reduced.

Variation (c)

In a control valve CV in which the first drain port 40DA and the second drain port 40DB are formed as in the first embodiment, for example, the communication path W is formed such that when the spool 50 is operated to be in the first advance position PA1, a portion of the hydraulic oil from the pump port 40P is discharged to the first drain port 40DA. Likewise, the communication path W is formed such that when the spool 50 is operated to be in the first retard position PB1, a portion of the hydraulic oil from the pump port 40P is discharged to the second drain port 40DB.

With the configuration described above, hydraulic oil can be discharged through the communication path W to the drain port to which hydraulic oil has not been discharged. In this configuration, as compared with a configuration in which, for example, the communication path W is connected to the drain port to which hydraulic oil has been discharged, the value of the relative rotation speed can be reduced to a desired value without the action of pressure from the hydraulic oil flowing through the drain port.

Variation (d)

The communication path W is configured by a flow path through which a portion of the hydraulic oil from the pump port 40P is discharged directly to the outside of the control valve CV when the spool 50 is operated to be in the first advance position PA1 or the first retard position PB1. With this configuration, as compared with a configuration in which the hydraulic oil is discharged to the drain port through the communication path W, the hydraulic oil can be discharged through the communication path W without being affected by the hydraulic oil flowing through the drain port, and thus the value of the relative rotation speed can be reduced to a desired value.

Second Embodiment

Figure 13:
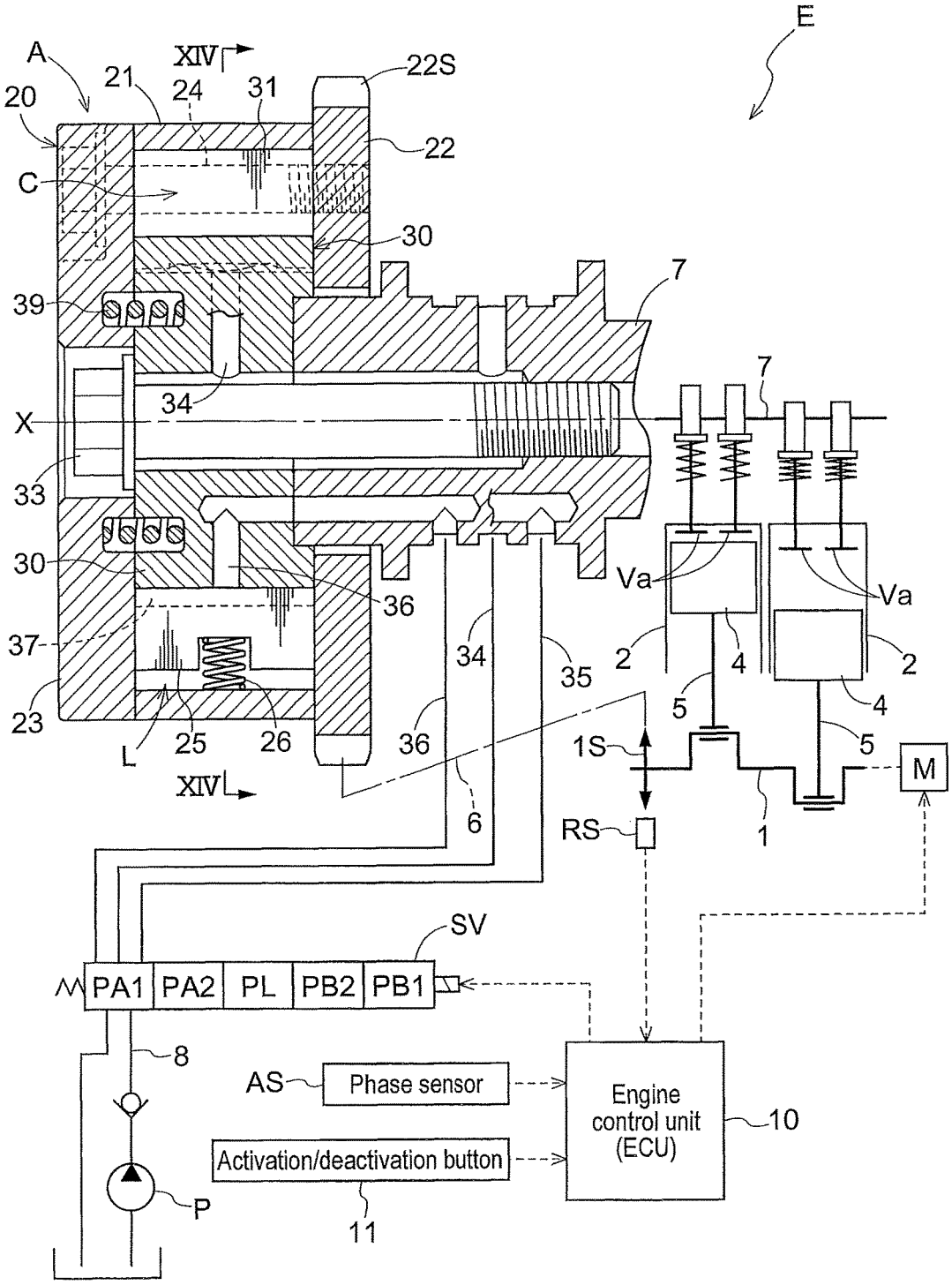
FIG. 13 is a cross-sectional view of a valve opening/closing timing control apparatus including a control valve according to a second embodiment.
Figures 14, 15:
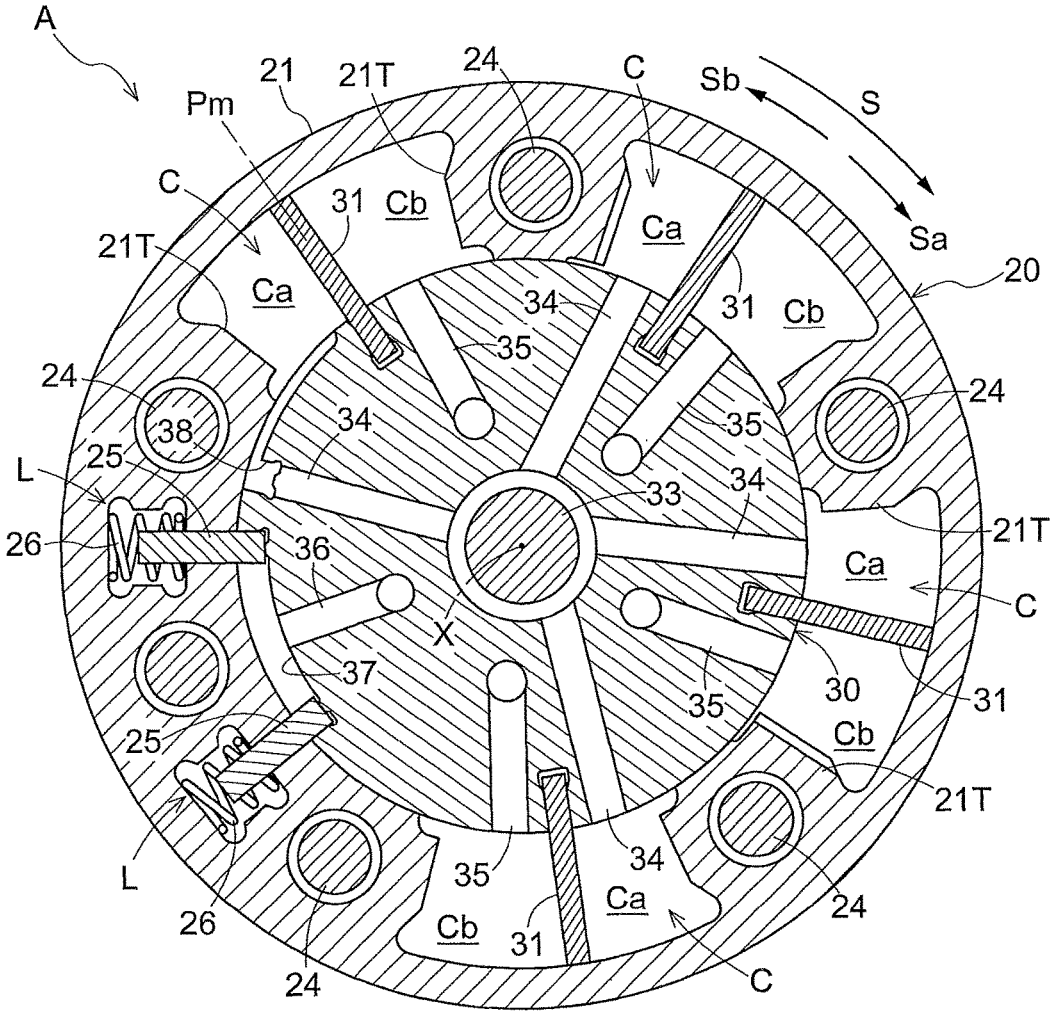
FIG. 14 is a cross-sectional view taken along the line XIV-XIV shown in FIG. 13.
FIG. 15 shows, in the form of a list, a supply/discharge relationship of hydraulic oil with respect to the position of the spool.

In a second embodiment, as shown in FIGS. 13 and 14, an internal combustion engine control system is configured to include a valve opening/closing timing control apparatus A, a solenoid valve SV (an example of the control valve) that controls the valve opening/closing timing control apparatus A with the use of oil pressure, and an engine control unit 10 configured as an ECU for controlling the activation and deactivation of the solenoid valve SV and an engine E.

An oil pressure pump P supplies, as hydraulic oil (an example of the fluid), a lubricant stored in an oil pan of the engine E to the solenoid valve SV via a supply flow path 8. The engine E includes a rotation speed sensor RS that detects the rotation speed (the number of rotations per unit time) of a crankshaft 1 and a starter motor M.

This system includes a phase sensor AS that detects a relative rotation phase (hereinafter referred to as "relative rotation phase") between an outer rotor 20 and an inner rotor 30. The system also includes, in a vehicle body, an activation/deactivation button 11 that activates and deactivates the engine E.

The engine control unit 10 receives input of a signal from the phase sensor AS, a signal from the activation/deactivation button 11 that deactivates and activates the engine E, and a signal from the rotation speed sensor RS. Also, the engine control unit 10 outputs a control signal to the solenoid valve SV, the starter motor M, and a fuel control system and an ignition control system that are required to operate the engine E, and the like.

In the internal combustion engine control system, when deactivating the engine E, control is performed to transition to a locked state in which the relative rotation phase is fixed to an intermediate locked phase Pm (an example of the intermediate phase) by a pair of locking mechanisms L of the valve opening/closing timing control apparatus A.

As shown in FIG. 13, a torsion spring 39 is provided that exerts a biasing force over the inner rotor 30 and the front plate 23 until the relative rotation phase between the outer rotor 20 and the inner rotor 30 reaches the intermediate locked phase Pm from a maximum retard phase, which will be described later. The torsion spring 39 may exert the biasing force to a range beyond the intermediate locked phase Pm shown in FIG. 14, or to a range behind the intermediate locked phase Pm.

In the second embodiment as well, the valve opening/closing timing control apparatus A is provided on an intake camshaft 7. However, the valve opening/closing timing control apparatus A may be provided on an exhaust camshaft, or the valve opening/closing timing control apparatus A may be provided on both the intake camshaft 7 and the exhaust camshaft.

In the inner rotor 30, an advance flow path 34 that communicates with an advance chamber Ca, a retard flow path 35 that communicates with a retard chamber Cb, and a lock releasing flow path 36 that communicates with an intermediate locking recess portion 37 are formed. A maximum retard locking recess portion 38 communicates with the advance flow path 34. Hydraulic oil is supplied to and discharged from the advance flow path 34, the retard flow path 35, and the lock releasing flow path 36 by the solenoid valve SV.

With this configuration, the engine control unit 10 controls the solenoid valve SV so as to supply hydraulic oil to one of the advance chamber Ca and the retard chamber Cb, thereby implementing control for setting the relative rotation phase in a range from the maximum retard phase to the maximum advance phase.

Solenoid Valve

As shown in FIGS. 16 to 20, the solenoid valve SV includes a valve case 40, a spool 50, an electromagnetic solenoid 60 and a spool spring 61. The spool 50 is housed in a spool housing space of the valve case 40 so as to be capable of reciprocation between one end and the other end of the valve case 40 along a spool axis Y. The electromagnetic solenoid 60 causes an electromagnetic force to be exerted in a direction against the biasing force of the spool spring 61 (an example of the biasing member) and shifts the spool 50.

Figure 16:
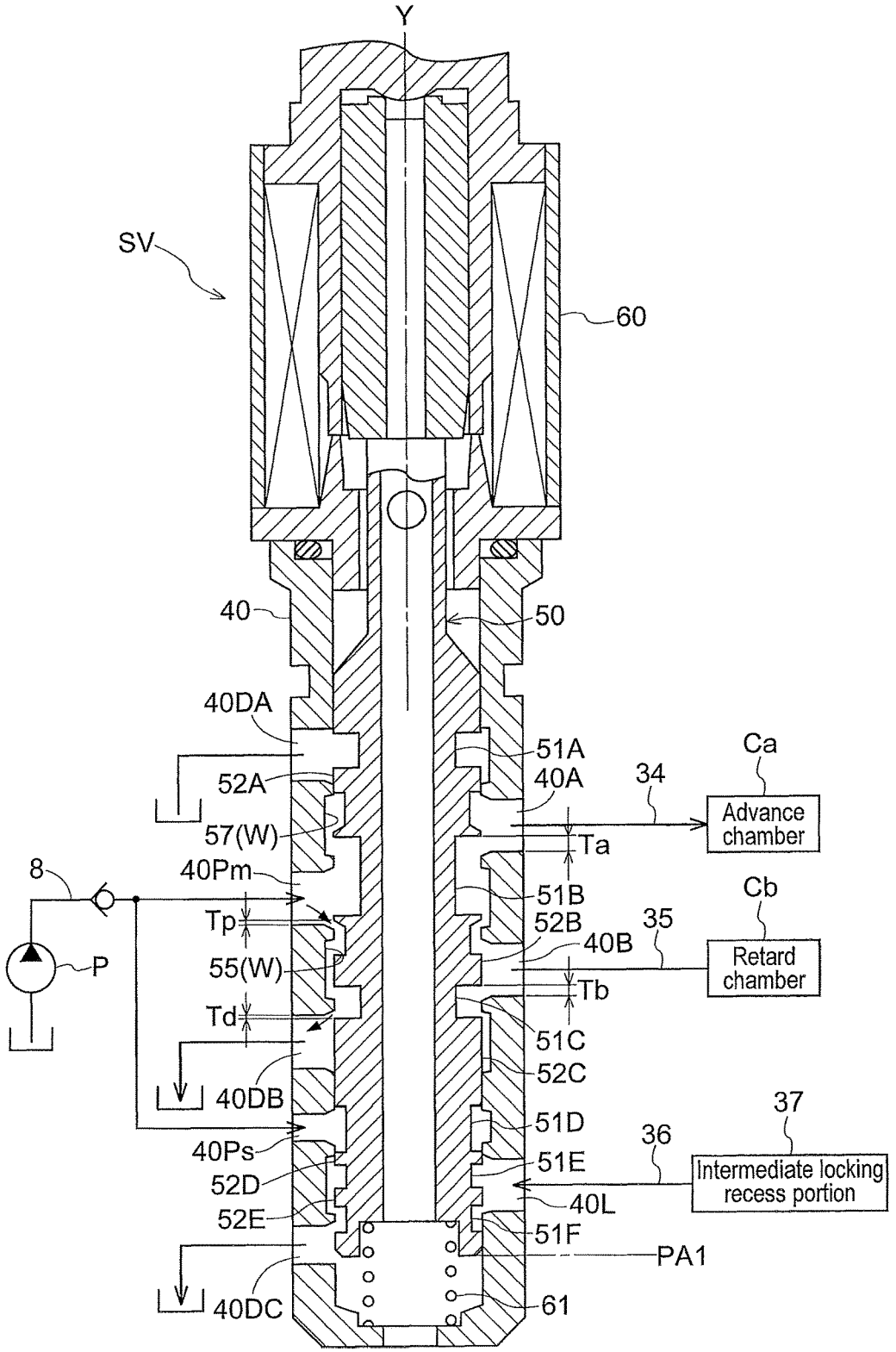
FIG. 16 is a cross-sectional view of a solenoid valve when a spool is positioned in a first advance position.

With the solenoid valve SV, the spool 50 is set to a first advance position PA1 (one end of the valve case 40) shown in FIG. 16 when power is not supplied to the electromagnetic solenoid 60. Also, with the solenoid valve SV, by increasing the power supplied to the electromagnetic solenoid 60, the spool 50 is set, against the biasing force of the spool spring 61, to one of a second advance position PA2, a lock releasing position PL, a second retard position PB2 and a first retard position PB1 (the other end of the valve case 40) as shown in FIGS. 17 to 20. The supply/discharge relationship of hydraulic oil with respect to each port in these positions is shown in FIG. 15.

In the valve case 40, a first drain port 40DA, an advance port 40A, a main pump port 40Pm, a retard port 40B, a second drain port 40DB (an example of the third port), an auxiliary pump port 40Ps (an example of the support), a lock releasing port 40L and a third drain port 40DC are formed sequentially in a direction extending along the spool axis Y from a position close to the electromagnetic solenoid 60.

In particular, the advance port 40A (an example of the first port) and the retard port 40B (an example of the second port) are disposed at positions in the direction extending along the spool axis Y so as to sandwich the main pump port 40Pm (an example of the main port). The first drain port 40DA is disposed in a position closest to the electromagnetic solenoid 60, and the second drain port 40DB is disposed in a position at a greater distance from the electromagnetic solenoid 60 than the retard port 40B.

Furthermore, the lock releasing port 40L (an example of the fourth port) and the third drain port 40DC (an example of the fifth port) are disposed in this order on a side of the auxiliary pump port 40Ps, the side being spaced apart from the electromagnetic solenoid 60 in the direction extending along the spool axis Y.

Instead of the embodiment described above, the solenoid valve SV may be configured by changing the positions of the advance port 40A and the retard port 40B (by changing the positions to which the advance flow path 34 and the retard flow path 35 are connected) without changing the configuration of the solenoid valve.

The main pump port 40Pm and the auxiliary pump port 40Ps communicate with the oil pressure pump P via the supply flow path 8. The advance port 40A communicates with the advance chamber Ca via the advance flow path 34. The retard port 40B communicates with the retard chamber Cb via the retard flow path 35. The lock releasing port 40L communicates with the intermediate locking recess portion 37 via the lock releasing flow path 36.

The spool 50 has a hollow cylindrical shape that is coaxial with the spool axis Y and that has a space that allows air to pass therethrough. The spool 50 includes first to sixth groove portions 51A to 51F and first to fifth land portions 52A to 52E that are formed sequentially in the direction extending along the spool axis Y from a position close to the electromagnetic solenoid 60.

As a specific placement, the second groove portion 51B is disposed in a position in communication with the main pump port 40Pm. The first land portion 52A and the second land portion 52B are disposed at positions sandwiching the second groove portion 51B. Furthermore, the first groove portion 51A is disposed in a position at a shorter distance from the electromagnetic solenoid 60 than the first land portion 52A, and the third groove portion 51C is disposed in a position at a shorter distance to the spool spring (the position opposite to the electromagnetic solenoid) than the second land portion 52B.

The first land portion 52A controls supply and discharge of hydraulic oil to and from the advance port 40A, and the second land portion 52B controls supply and discharge of hydraulic oil to and from the retard port 40B.

The fourth groove portion 51D is disposed in a position capable of communicating with the auxiliary pump port 40Ps. The third land portion 52C and the fourth land portion 52D are disposed at positions sandwiching the fourth groove portion 51D. Furthermore, the sixth groove portion 51F, the fifth land portion 52E and the sixth groove portion 51F are disposed at positions at shorter distances to the spool spring than the fifth groove portion 51E.

With the solenoid valve SV, an advance-side deceleration flow path 55 (communication path W) and a retard-side deceleration flow path 57 (communication path W) are formed by processing the outer circumferences of the second groove portion 51B and the first groove portion 51A and part of the inner circumferential surface of the valve case 40.

The advance-side deceleration flow path 55 functions to deliver a portion of the fluid, which is supplied from the main pump port 40Pm to the advance port 40A, to the retard port 40B and the second drain port 40DB when the spool 50 is set to the first advance position PA1 shown in FIG. 16. Likewise, the retard-side deceleration flow path 57 functions to deliver a portion of the fluid, which is supplied from the main pump port 40Pm to the retard port 40B, to the advance port 40A and the first drain port 40DA when the spool 50 is set to the first retard position PB1 shown in FIG. 20.

That is, as shown in FIG. 15, in the first advance position PA1, the advance-side deceleration flow path 55 functions to cause the advance chamber Ca and the retard chamber Cb to communicate with each other, and in the first retard position PB1, the retard-side deceleration flow path 57 functions to cause the advance chamber Ca and the retard chamber Cb to communicate with each other. The flow of fluid in each position will be described later.

The engine control unit 10 includes a power supply system that supplies power to the electromagnetic solenoid 60 intermittently in a short cycle. The amount of shift of the spool 50 is set by adjusting the power by setting the duty ratio of the power.

First Advance Position

As shown in FIG. 16, when the spool 50 is positioned in the first advance position PA1 (one end of the valve case 40), due to the positional relationship between the first land portion 52A and the advance port 40A, the advance port 40A communicates with the main pump port 40Pm via the second groove portion 51B. Also, due to the positional relationship between the second land portion 52B and the retard port 40B, the retard port 40B and the second drain port 40DB communicate with each other. At the same time, due to the positional relationship between the fifth groove portion 51E, the sixth groove portion 51F, and the lock releasing port 40L, the lock releasing port 40L and the third drain port 40DC communicate with each other.

Accordingly, in the first advance position PA1, the hydraulic oil from the main pump port 40Pm is supplied to the advance port 40A, the hydraulic oil is discharged from the retard port 40B, and the hydraulic oil is discharged from the lock releasing port 40L. Consequently, when the locking mechanism L is in the locked state, the advance chamber Ca and the retard chamber Cb can be filled with the hydraulic oil. When the locking mechanism L is not in the locked state, an amount of hydraulic oil greater than that supplied to the retard chamber Cb is supplied to the advance chamber Ca to cause the relative rotation phase to be displaced in the advance direction Sa. When the relative rotation phase reaches the intermediate locked phase Pm, the locking members 25 of the locking mechanism L are engaged with the intermediate locking recess portion 37 to achieve transition to the intermediate locked state. The flow of hydraulic oil through the advance-side deceleration flow path 55 will be described later in detail.

Second Advance Position

Figure 17:
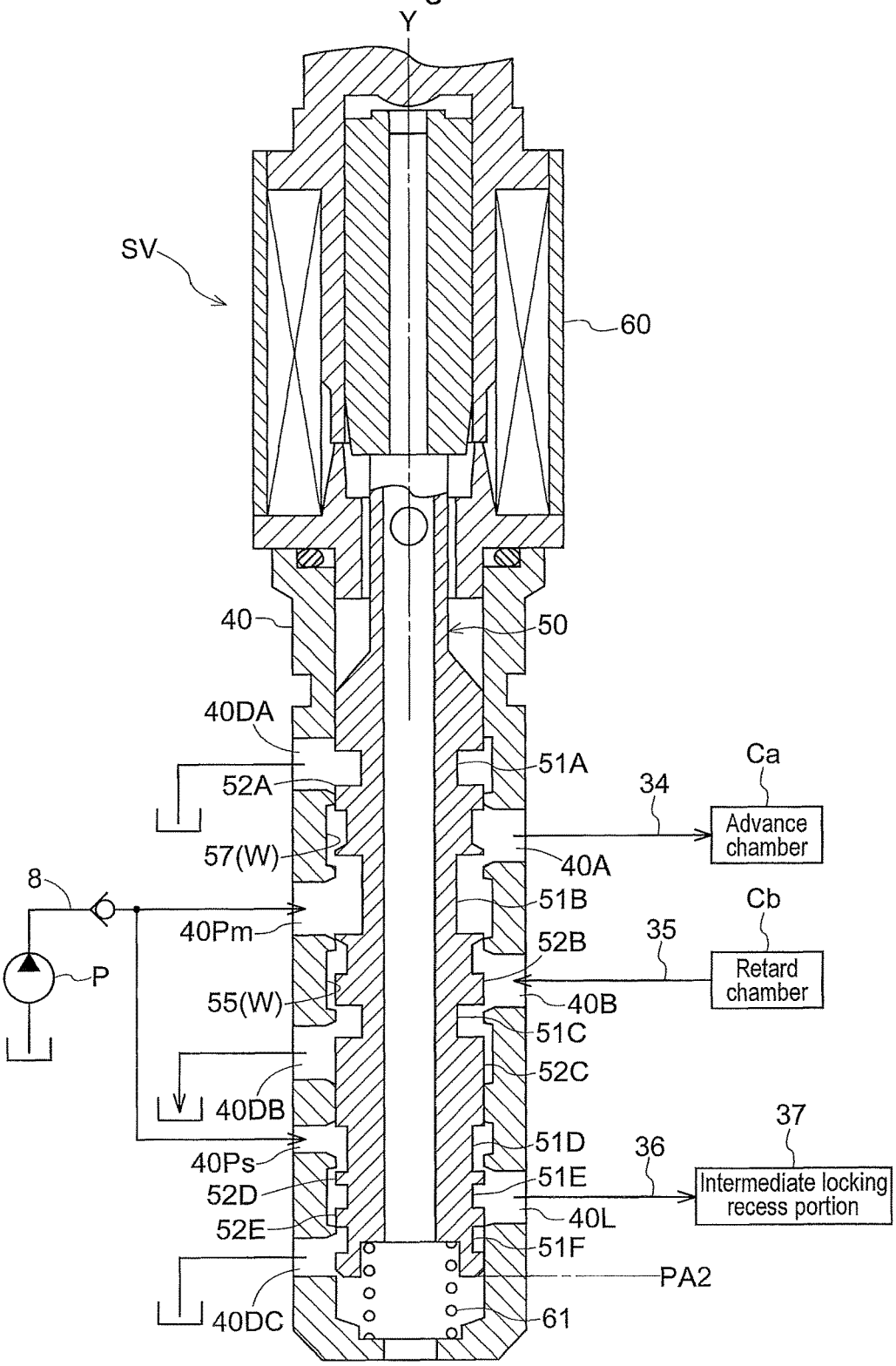
FIG. 17 is a cross-sectional view of the solenoid valve when the spool is positioned in a second advance position.

As shown in FIG. 17, when the spool 50 is set to the second advance position PA2, due to the positional relationship between the first land portion 52A and the advance port 40A, the advance port 40A communicates with the main pump port 40Pm via the second groove portion 51B. Also, due to the positional relationship between the second land portion 52B and the retard port 40B, the retard port 40B and the second drain port 40DB communicate with each other. At the same time, due to the positional relationship between the fifth groove portion 51E, the sixth groove portion 51F and the lock releasing port 40L, the lock releasing port 40L and the auxiliary pump port 40Ps communicate with each other.

Accordingly, in the second advance position PA2, the hydraulic oil from the main pump port 40Pm is supplied to the advance port 40A, the hydraulic oil is discharged from the retard port 40B, and the hydraulic oil is supplied to the lock releasing port 40L, and thus the relative rotation phase is displaced to the advance direction Sa. Consequently, when the locking mechanism L is in the locked state in the intermediate locked phase Pm, the locked state is released to displace the relative rotation phase in the advance direction Sa.

Lock Releasing Position

Figure 18:
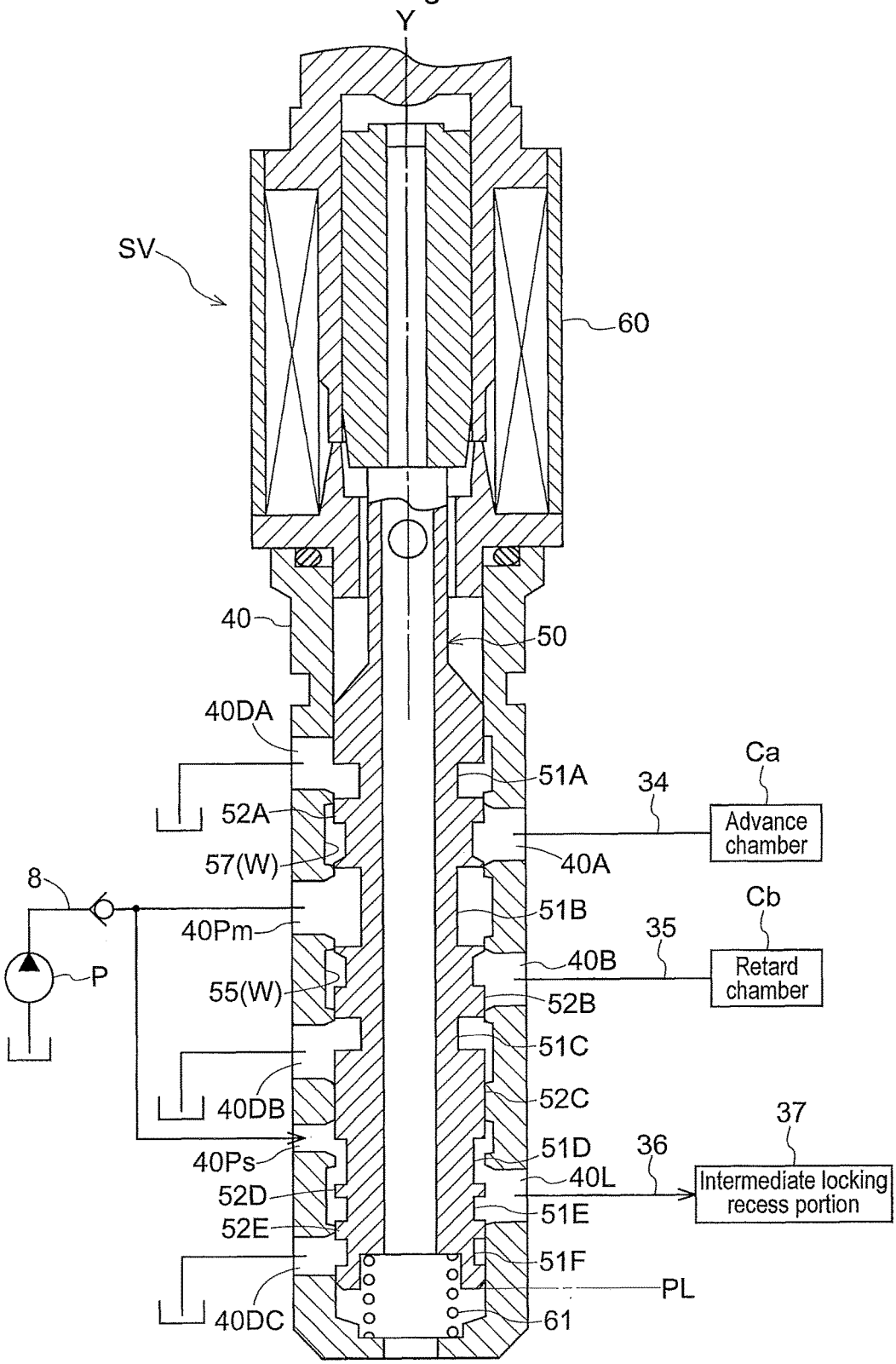
FIG. 18 is a cross-sectional view of the solenoid valve when the spool is positioned in a lock releasing position.

As shown in FIG. 18, when the spool 50 is positioned in the lock releasing position PL, the first land portion 52A closes the advance port 40A, and the second land portion 52B closes the retard port 40B. At the same time, due to the positional relationship between the fifth groove portion 51E, the sixth groove portion 51F and the lock releasing port 40L, the lock releasing port 40L and the auxiliary pump port 40Ps communicate with each other.

Accordingly, in the lock releasing position PL, the hydraulic oil from the main pump port 40Pm is supplied to neither the advance port 40A nor the retard port 40B, but is supplied to the lock releasing port 40L, and thus the relative rotation phase is maintained.

Second Retard Position

Figure 19:
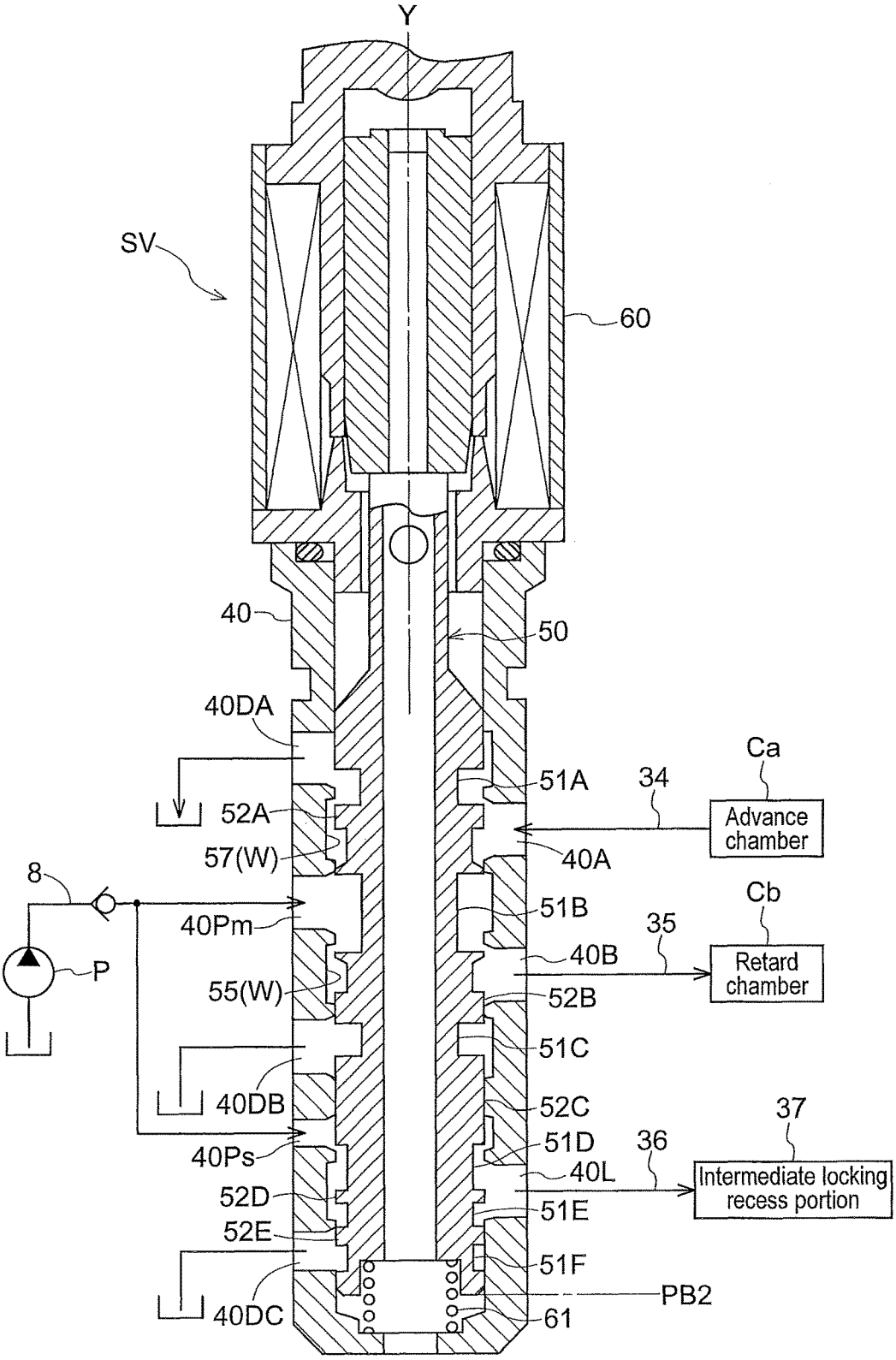
FIG. 19 is a cross-sectional view of the solenoid valve when the spool is positioned in a second retard position.

As shown in FIG. 19, when the spool 50 is set to the second retard position PB2, due to the positional relationship between the first land portion 52A and the advance port 40A, the advance port 40A communicates with the first drain port 40DA via the first groove portion 51A. Also, due to the positional relationship between the second land portion 52B and the retard port 40B, the retard port 40B communicates with the main pump port 40Pm. At the same time, due to the positional relationship between the fifth groove portion 51E, the sixth groove portion 51F and the lock releasing port 40L, the lock releasing port 40L and the auxiliary pump port 40Ps communicate with each other.

Accordingly, in the second retard position PB2, the hydraulic oil from the main pump port 40Pm is supplied to the retard port 40B, the hydraulic oil is discharged from the advance port 40A, and the hydraulic oil is supplied to the lock releasing port 40L, and thus the relative rotation phase is displaced in the retard direction Sb. Consequently, when the locking mechanism L is in the locked state in the intermediate locked phase Pm, the locked state is released to displace the relative rotation phase in the retard direction Sb.

First Retard Position

Figure 20:
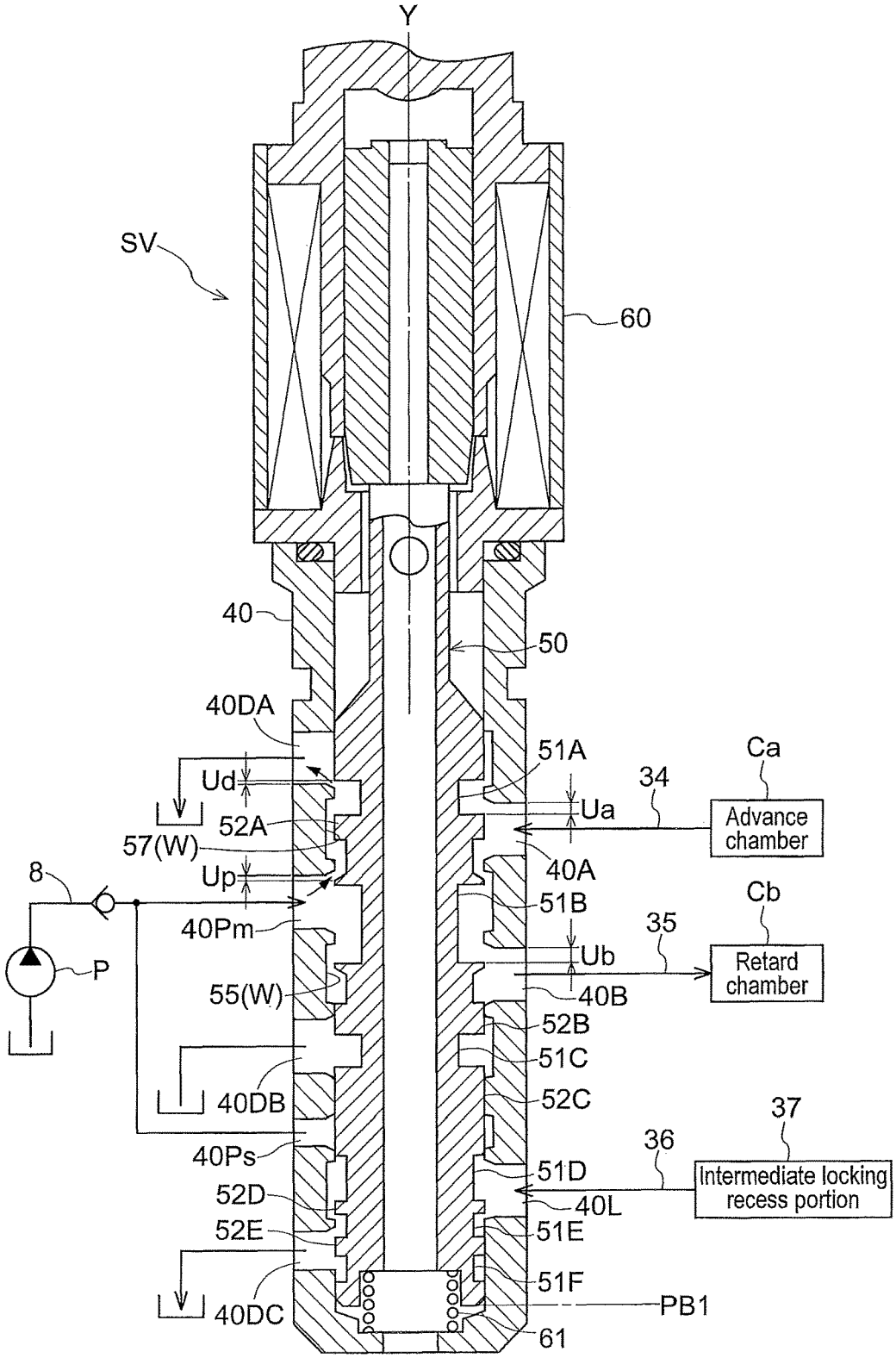
FIG. 20 is a cross-sectional view of the solenoid valve when the spool is positioned in a first retard position.

As shown in FIG. 20, when the spool 50 is set to the first retard position PB1 (the other end of the valve case 40), due to the positional relationship between the first land portion 52A and the advance port 40A, the advance port 40A communicates with the first drain port 40DA via the first groove portion 51A. Also, due to the positional relationship between the second land portion 52B and the retard port 40B, the retard port 40B communicates with the main pump port 40Pm. At the same time, due to the positional relationship between the fifth groove portion 51E, the sixth groove portion 51F and the lock releasing port 40L, the lock releasing port 40L and the third drain port 40DC communicate with each other.

Accordingly, in the first retard position PB1, the hydraulic oil from the main pump port 40Pm is supplied to the retard port 40B, the hydraulic oil is discharged from the advance port 40A, and the hydraulic oil is discharged from the lock releasing port 40L. Consequently, when the locking mechanism L is in the locked state, the advance chamber Ca and the retard chamber Cb can be filled with the hydraulic oil. When the locking mechanism L is not in the locked state, an amount of hydraulic oil greater than that supplied to the advance chamber Ca is supplied to the retard chamber Cb so as to displace the relative rotation phase in the retard direction Sb. When the relative rotation phase reaches the intermediate locked phase Pm, the locking members 25 of the locking mechanism L are engaged with the intermediate locking recess portion 37 to achieve transition to the locked state. The flow of hydraulic oil through the retard-side deceleration flow path 57 will be described later in detail.

Flow of Hydraulic Oil Through Advance-Side Deceleration Flow Path

When deactivating the engine E through an operation of the activation/deactivation button 11, the engine control unit 10 performs control so as to displace the relative rotation phase of the valve opening/closing timing control apparatus A to the intermediate locked phase Pm and to completely deactivate the engine E after the transition to the intermediate locked state has completed. When the engine E is deactivated as described above, the solenoid valve SV is set to the first advance position PA1 or the second retard position PB2.

With this control, in many cases, the valve opening/closing timing control apparatus A reaches the intermediate locked phase Pm, and the locking mechanism L reaches the locked state. However, the locking mechanism L cannot transition to the locked state by this control in some cases. In addition, the engine E is deactivated without the pair of locking mechanisms L transitioning to the locked state in some cases, as with an engine stall. In the case of activating the engine E while the locking mechanism L is in an unlocked state, the engine control unit 10 performs control for transitioning to a state in which the locking mechanism L is locked in the intermediate locked phase Pm.

As a specific example of this control, if the relative rotation phase detected by the phase sensor AS is in the intermediate locked phase Pm when activating the engine E, the spool 50 of the solenoid valve SV is set to the first advance position PA1. However, if the relative rotation phase detected by the phase sensor AS is not in the intermediate locked phase Pm (the locking mechanism L is in the unlocked state) when activating the engine E, the spool 50 of the solenoid valve SV is set to the first advance position PA1, or the spool 50 of the solenoid valve SV is set to the first retard position PB1, so as to perform control for changing the relative rotation phase to the intermediate locked phase Pm.

That is, when the spool 50 is positioned in the first advance position PA1, due to the positional relationship between the first land portion 52A and the advance port 40A, the advance port 40A communicates with the main pump port 40Pm in an advance port opening area Ta. Also, due to the positional relationship between the second land portion 52B and the retard port 40B, the retard port 40B communicates with the second drain port 40DB in a retard port opening area Tb.

Figure 21:
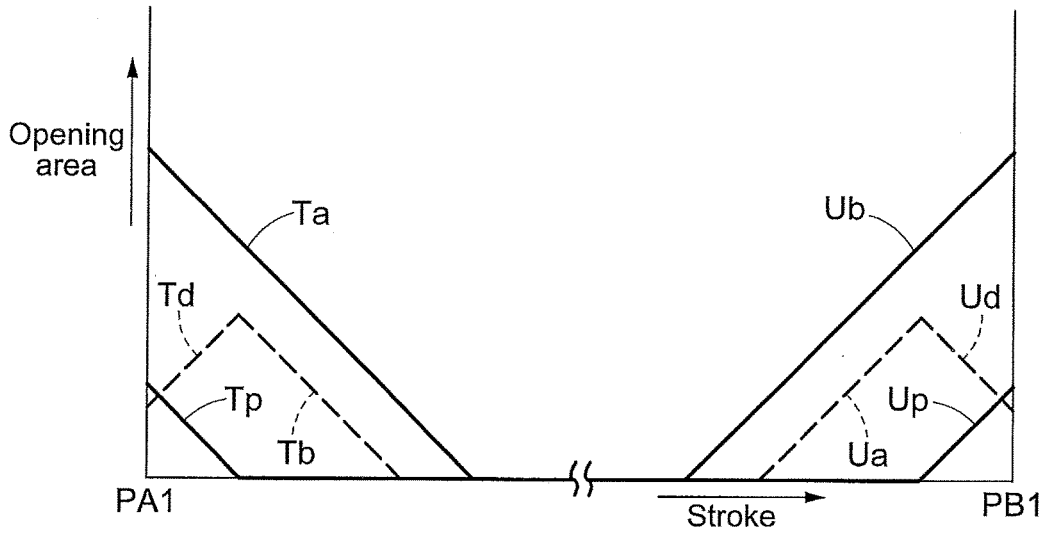
FIG. 21 is a diagram showing a relationship between the stroke of the spool and the opening area of ports, etc.

With the solenoid valve SV, as shown in FIG. 16, when the spool 50 is positioned in the first advance position PA1, an end of the advance-side deceleration flow path 55 on the main pump port 40Pm side communicates with the main pump port 40Pm in a pump-side opening area Tp, and an end of the advance-side deceleration flow path 55 on the second drain port 40DB side communicates with the second drain port 40DB in a drain-side opening area Td FIG. 21 shows a relationship between the advance port opening area Ta, the retard port opening area Tb, the pump-side opening area Tp and the drain-side opening area Td versus the stroke at the time of operation of the spool 50. In this diagram, the left end indicates the first advance position PA1, and the right end indicates the first retard position PB1. In the first advance position PA1, the spool 50 is not operated, but the graph is made on the assumption that the spool 50 is operated.

Particularly when the spool 50 is set to the first advance position PA1, the pump-side opening area Tp is set to be larger than the drain-side opening area Td (Tp>Td), and the retard port opening area Tb is set to be larger than the drain-side opening area Td (Tb>Td).

Consequently, when the spool 50 is positioned in the first advance position PA1, most of the hydraulic oil from the main pump port 40Pm is supplied to the advance port 40A, and a portion of the hydraulic oil from the main pump port 40Pm flows into the retard port 40B and the second drain port 40DB via the advance-side deceleration flow path 55. When the hydraulic oil flows as described above, because the drain-side opening area Td is set to be narrow, an amount of hydraulic oil greater than the amount of hydraulic oil discharged is supplied to the retard port 40B.

Consequently, when the locking mechanism L is in the unlocked state, the speed of displacement of the relative rotation phase is decelerated, and thus when the relative rotation phase reaches the intermediate locked phase Pm, an operation is performed to cause the locking members 25 to engage into the intermediate locking recess portion 37 so as to reliably perform the transition to the locked state.

Flow of Hydraulic Oil Through Retard-Side Deceleration Flow Path

As described above, in the case of activating the engine E while the locking mechanism L is in the unlocked state, if the relative rotation phase is on the advance-side with respect to the intermediate locked phase Pm, the relative rotation phase is displaced to the intermediate locked phase Pm, and thus the engine control unit 10 may set the spool 50 of the solenoid valve SV to the first retard position PB1.

That is, when the spool 50 is positioned in the first retard position PB1, due to the positional relationship between the second land portion 52B and the retard port 40B, the retard port 40B communicates with the main pump port 40Pm in a retard port opening area Ub. Also, due to the positional relationship between the first land portion 52A and the advance port 40A, the advance port 40A communicates with the first drain port 40DA in an advance port opening area Ua.

In the solenoid valve SV, as shown in FIG. 20, when the spool 50 is positioned in the first retard position PB1, an end on the main pump port 40Pm side of the retard-side deceleration flow path 57 communicates with the main pump port 40Pm in a pump-side opening area Up, and an end on the first drain port 40DA side of the retard-side deceleration flow path 57 communicates with the first drain port 40DA in a drain-side opening area Ud.

When the spool 50 is positioned in the first retard position PB1, the advance port opening area Ua, the retard port opening area Ub, the pump-side opening area Up and the drain-side opening area Ud change as shown in the graph of FIG. 21.

When the spool 50 is positioned in the first retard position PB1, the pump-side opening area Up is set to be larger than the drain-side opening area Ud (Up>Ud), and the advance port opening area Ua is set to be larger than the drain-side opening area Ud (Ua>Ud).

Consequently, when the spool 50 is set to the first retard position PB1, most of the hydraulic oil from the main pump port 40Pm is supplied to the retard port 40B, and a portion of the hydraulic oil from the main pump port 40Pm flows into the advance port 40A and the first drain port 40DA via the retard-side deceleration flow path 57. When the hydraulic oil flows as described above, because the drain-side opening area Ud is set to be narrow, an amount of hydraulic oil greater than the amount of hydraulic oil discharged is supplied to the advance port 40A, which enables the speed of displacement of the relative rotation phase to be decelerated. As a result, when the relative rotation phase reaches the intermediate locked phase Pm, an operation is performed to cause the locking members 25 to engage into the intermediate locking recess portion 37 so as to reliably perform the transition to the locked state.

Actions and Effects of Embodiment

As described above, when the locking mechanism L is positioned in the intermediate locked phase Pm at the time of activation of the engine E, the hydraulic oil is supplied to the advance chamber Ca and the retard chamber Cb irrespective of the spool being set to the first advance position PA1 or the first retard position PB1. Because filling of the advance chamber Ca and the retard chamber Cb with the fluid starts in this way, even when the locked state of the locking mechanism L is released, it is possible to suppress a significant variation of the relative rotation phase caused by torque from the intake camshaft 7.

When the locking mechanism L is not positioned in the intermediate locked phase Pm at the time of activation of the engine E, by setting the spool 50 of the solenoid valve SV to the first advance position PA1 or the first retard position PB1, the displacement of the relative rotation phase of the valve opening/closing timing control apparatus A is performed at a low speed. When the relative rotation phase reaches the intermediate locked phase Pm by this displacement, the pair of locking members 25 can be reliably engaged with the intermediate locking recess portion 37, and the intermediate locked phase Pm can be maintained by the locking mechanism L.

Variations of Second Embodiment

Variation (2a)

Figure 22:
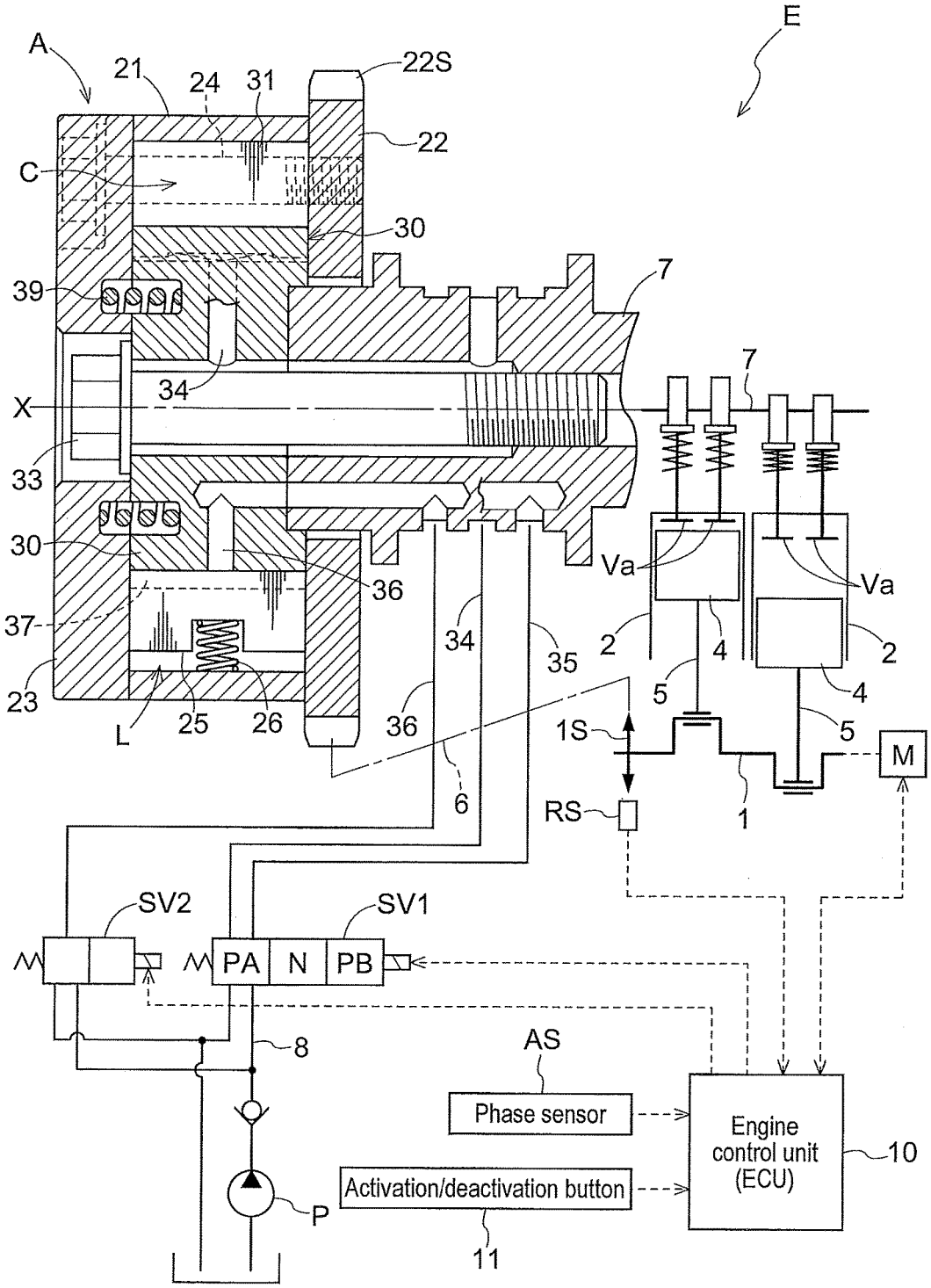
FIG. 22 is a diagram showing an overall configuration of an internal combustion engine control system according to Variation (2a) of the second embodiment.
Figure 23:
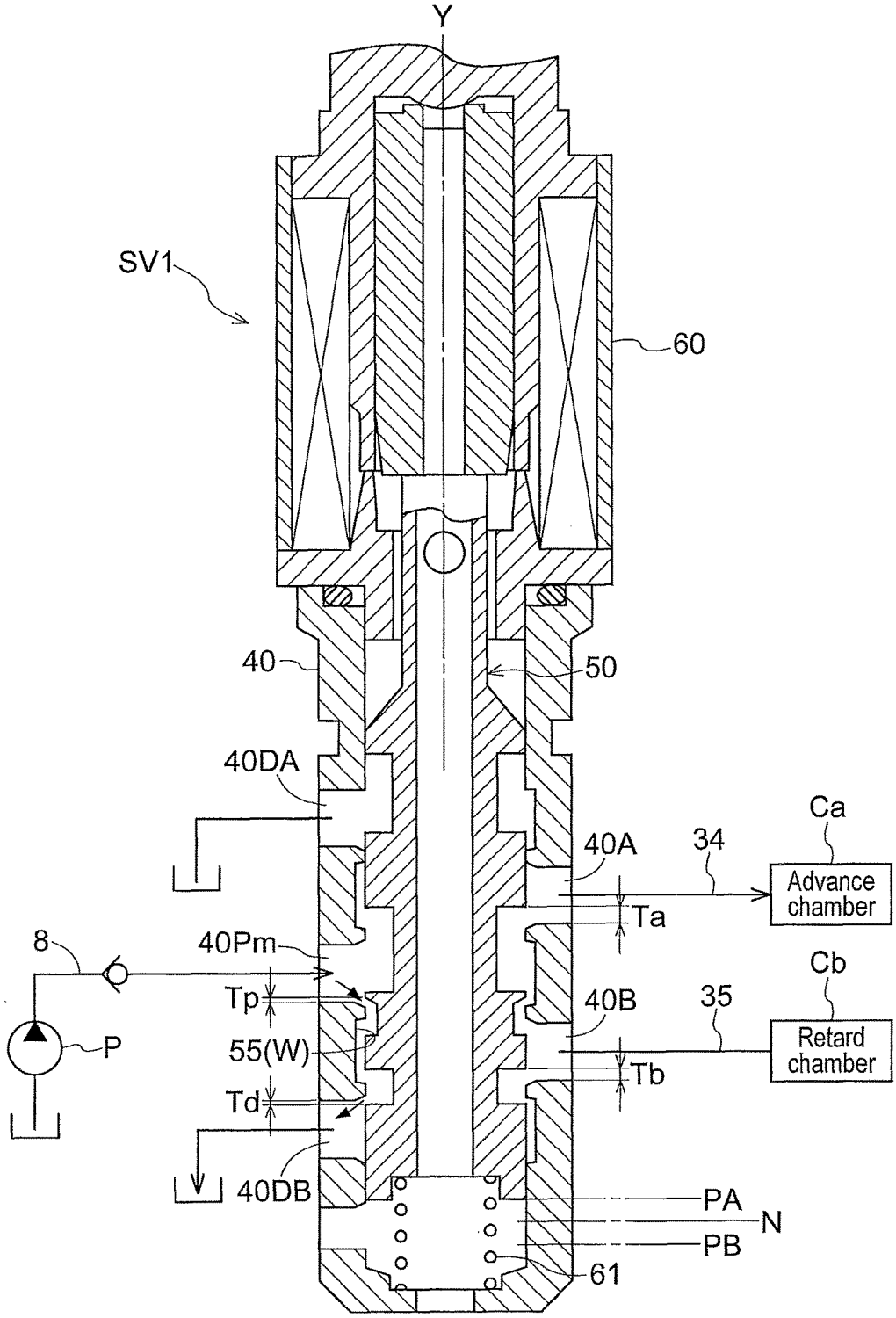
FIG. 23 is a cross-sectional view of a solenoid valve according to Variation (2a) of the second embodiment.

As shown in FIGS. 22 to 24, a solenoid valve SV is configured to include a phase control valve SV1 and a lock control valve SV2. The phase control valve SV1 is configured to supply and discharge hydraulic oil to and from the advance chamber Ca and the retard chamber Cb, and is configured to be capable of being operated in an advance position PA, a neutral position N and a retard position PB. In Variation (2a), constituent elements that correspond to those of the second embodiment are given the same reference numerals and characters as those of the second embodiment.

As shown in FIG. 23, when power is not supplied to the electromagnetic solenoid 60, the phase control valve SV1 is set to the advance position PA due to the biasing force of the spool spring 61. In the advance position PA, the hydraulic oil from the oil pressure pump P is supplied to the advance chamber Ca, and the hydraulic oil from the retard chamber Cb is discharged. Also, in the advance position PA, the advance-side deceleration flow path 55 performs its function.

As shown in FIG. 23, the phase control valve SV1 has the same configuration as that of the solenoid valve SV described in the second embodiment except that the elements for controlling the locking mechanism L (the auxiliary pump port 40Ps, the lock releasing port 40L, the fourth to sixth groove portions, the fourth and fifth land portions, etc.) are removed. In addition, the phase control valve SV1 does not include the retard-side deceleration flow path 57 of the second embodiment.

With an increase in the power supplied to the electromagnetic solenoid 60, the phase control valve SV1 reaches the neutral position N. In the neutral position N, the supply and discharge of hydraulic oil to and from the advance chamber Ca and the retard chamber Cb is inhibited. Furthermore, by an increase in the power supplied to the electromagnetic solenoid 60, the phase control valve SV1 reaches the retard position PB. In the retard position PB, the hydraulic oil from the oil pressure pump P is supplied to the retard chamber Cb, and the hydraulic oil of the advance chamber Ca is discharged.

Furthermore, the lock control valve SV2 is configured as a two-position switching type that controls the supply and discharge of fluid to and from the intermediate locking recess portion 37. With the solenoid valve SV including the phase control valve SV1 and the lock control valve SV2, the timing of releasing the locked state of the locking mechanism L can be set to an arbitrary timing. Accordingly, when the locking mechanism L is in the locked state at the time of activation of the engine E, the locked state can be released after the advance chamber Ca and the retard chamber Cb are sufficiently filled with hydraulic oil, and thus variation of the relative rotation phase can be suppressed.

FIG. 24 shows a supply/discharge relationship of hydraulic oil with respect to each port in the three positions of the phase control valve SV1. As shown in the diagram, when the spool 50 is positioned in the advance position PA, the advance-side deceleration flow path 55 functions so as to cause the advance chamber Ca and the retard chamber Cb to communicate with each other. Also, the flow of hydraulic oil through the advance-side deceleration flow path 55 is inhibited before the phase control valve SV1 reaches the neutral position N from the advance position PA, and the speed of displacement in the advance direction Sa increases.

With the configuration according to Variation (2a) as well, when the spool 50 of the phase control valve SV1 is set to the advance position PA, as described in connection with the advance-side deceleration flow path 55 in the second embodiment, the hydraulic oil flows and the speed of displacement of the relative rotation phase in the advance direction Sa is reduced.

As a variation of Variation (2a), as in the first retard position PB1 of the second embodiment, it is possible to provide a retard-side deceleration flow path 57 that causes the advance chamber Ca and the retard chamber Cb to be in communication when the spool 50 is set to the retard position PB. With the configuration according to the present variation, it is possible to reduce the speed of displacement in the retard direction Sb.

Variation (2b)

Instead of the locking mechanism L of the second embodiment that includes a pair of locking members 25 and locking springs 26 corresponding to the locking members 25, it is possible to use a locking mechanism L that includes a single locking member 25 and a single locking spring 26. Also, as a configuration that uses a pair of locking mechanisms L, the locking mechanisms L may be disposed at two opposite positions across the rotation axis X. The present embodiment is also a variation of the locking mechanism L according to the first embodiment.

Variation (2c)

Only an advance-side deceleration flow path 55 corresponding to the first advance position PA1 that is set when power is not supplied to the electromagnetic solenoid 60 is formed. In this way, by forming a single deceleration flow path, the configuration of the solenoid valve SV can be simplified and the cost of the solenoid valve SV can be reduced.

Variation (2d)

An advance-side deceleration flow path 55 is formed at least in one of the outer circumference of a land and the inner circumference of the valve case 40. By forming the advance-side deceleration flow path 55 in one of the outer circumference of the land and the inner circumference of the valve case 40, the solenoid valve SV can be easily manufactured. Likewise, a retard-side deceleration flow path 57 may be formed.

INDUSTRIAL APPLICABILITY

The present invention is applicable to a control valve that performs, with a single spool operation, the displacement of the valve opening/closing timing control apparatus A in the advance direction, the displacement thereof in the retard direction, and the release of the locked state.

REFERENCE SIGNS LIST

1: crankshaft
7: camshaft (intake camshaft)
20: driving rotary body (outer rotor)
25: locking member
30: driven rotary body (inner rotor)
37: engaging portion/lock releasing space (intermediate locking recess portion)
40: valve case
40A: advance port (first port)
40B: retard port (second port)
40DA: drain port/phase controlling drain port (first drain port)
40DB: drain port/phase controlling drain port (second drain port, third port)
40DC: drain port/lock releasing drain port (third drain port, fifth port)
40P: pump port
40Pm: main port (main pump port)
40Ps: sub-port (auxiliary pump port)
40L: lock releasing port (fourth port)
50: spool
53: phase control flow path
55: communication path (advance-side deceleration flow path)
57: communication path (retard-side deceleration flow path)
60: electromagnetic solenoid
61: biasing member (spool spring)
A: valve opening/closing timing control apparatus
E: internal combustion engine
Ca: advance chamber
Cb: retard chamber
P: fluid pressure pump (oil pressure pump)
Pm: intermediate phase (intermediate locked phase)
L: locking mechanism
Y: axis of spool (spool axis)
W: communication path
PL: lock releasing position
Ta: opening area (advance port opening area)
Tb: opening area (retard port opening area)
Tp: opening area (pump-side opening area)
Td: opening area (drain-side opening area)

The invention claimed is:

1. A control valve for a valve opening/closing timing control apparatus including a driving-side rotary body that synchronously rotates with a crankshaft of an internal combustion engine; a driven-side rotary body that rotates together with a camshaft of the internal combustion engine and rotates relative to the driving-side rotary body, a relative rotation phase between the driving-side rotary body and the driven-side rotary body being displaced in an advance direction by a fluid being supplied to an advance chamber and being displaced in a retard direction by the fluid being supplied to a retard chamber; and a locking mechanism that holds the relative rotation phase to a predetermined locked phase by engagement of a locking member with an engaging portion formed on one of the driving-side rotary body and the driven-side rotary body, the locking member being supported by the other of the driving-side rotary body and the driven-side rotary body, the control valve comprising: a valve case; a spool housed in the valve case; and an electromagnetic solenoid that drives the spool such that the spool moves along an axis of the spool, the valve case comprising a pump port to which the fluid is supplied; an advance port that communicates with the advance chamber; a retard port that communicates with the retard chamber; a lock releasing port that communicates with a lock releasing space of the locking member; and a drain port that allows the fluid to be discharged, wherein the spool is configured to be movable between a plurality of phase control positions and a lock transition position, the plurality of phase control positions being set to control supply and discharge of the fluid to and from the advance port and the retard port when the fluid is supplied to the lock releasing port, and the lock transition position being set to control supply and discharge of the fluid to and from the advance port and the retard port when the fluid is discharged from the lock releasing port, and a communication path that allows a portion of the fluid supplied to the pump port to flow directly into the drain port when the spool is set to the lock transition position is formed.

2. The control valve according to claim 1, wherein the spool is configured to be movable between the plurality of phase control positions and a plurality of the lock transition positions, wherein a first of the plurality of lock transition positions in which the fluid is supplied to the advance port is disposed in a position adjacent to one of the plurality of phase control positions in which the fluid is supplied to the advance port, a second of the plurality of lock transition positions in which the fluid is supplied to the retard port is disposed in a position adjacent to one of the plurality of phase control positions in which the fluid is supplied to the retard port, and the communication path is closed in a region of one of the plurality of lock transition positions, the region being adjacent to one of the plurality of phase control positions.

3. The control valve according to claim 1, wherein a phase control flow path that allows the fluid to be supplied from the pump port to the advance port and the retard port is formed in the spool, and the communication path has a cross-sectional flow area smaller than a cross-sectional flow area of the phase control flow path.

4. The control valve according to claim 1, wherein the drain port includes a lock releasing drain port that allows the fluid from the lock releasing port to be discharged to outside of the valve case and a phase controlling drain port that allows the fluid from the communication path to be discharged to the outside of the valve case.

5. The control valve according to claim 4, wherein the phase controlling drain port has a function of allowing the fluid from the advance port to be discharged to the outside of the valve case and a function of allowing the fluid from the retard port to be discharged to the outside of the valve case.

6. A control valve comprising:

a valve case, the valve case including a main port through which a fluid expelled from an external fluid pressure pump is supplied, a first port and a second port that allow the fluid flowed into the main port to flow into an advance chamber or a retard chamber of a valve opening/closing timing control apparatus included in an internal combustion engine to flow out of the advance chamber or the retard chamber, and a third port that allows the fluid flowing from the valve opening/closing timing control apparatus via the first port or the second port to be discharged;

a spool included in the valve case to be reciprocatable between a first end of the valve case and a second end of the valve case; and an electromagnetic solenoid that drives and operates the spool, wherein when the spool is positioned at the first end or the second end of the valve case, the main port communicates with the first port, and the second port communicates with the third port, the second port also communicates with the main port.

7. The control valve according to claim 6, wherein the valve opening/closing timing control apparatus includes a locking mechanism that is operated by the fluid so as to fix a valve opening/closing timing to an intermediate phase between a maximum advance phase and a maximum retard phase, and the valve case further includes:

a sub-port that receives the fluid from the fluid pressure pump;

a fourth port that allows the fluid flowing out of the sub-port to flow into the locking mechanism or to flow out of the locking mechanism; and a fifth port that sets the locking mechanism to a locked state by allowing the fluid flowing from the locking mechanism via the fourth port to be discharged when the spool is positioned at one of the first and second ends of the valve case.

8. The control valve according to claim 6, comprising a spring that biases the spool to the first end of the valve case when power supplied to the electromagnetic solenoid reaches zero.

9. The control valve according to claim 8, wherein the spool is positioned at the second end of the valve case when the power supplied to the electromagnetic solenoid reaches a maximum level, and concurrently, the main port communicates with the second port, and the first port communicates with the third port and the main port so as to cause the advance chamber and the retard chamber to communicate with each other.

10. The control valve according to claim 6, wherein when the spool is positioned at one of the first and second ends of the valve case and the first port or the second port communicates with the third port and the main port, the first port or the second port communicating with the main port has an opening area larger than an area of an opening communicating with the third port.

11. The control valve according to claim 10, wherein when the spool is positioned at one of the first and second ends of the valve case and the first port or the second port communicates with the third port and the main port, a portion of a communication path communicating with the main port has an opening area larger than an opening area of a portion of the communication path communicating with the third port, the communication path which communicates from the main port to the third port.

12. The control valve according to claim 6, comprising a spring that biases the spool to the first end of the valve case, wherein the spool is disposed at the first end of the valve case when an electromagnetic force of the electromagnetic solenoid is smaller than a biasing force of the spring.

13. The control valve according to claim 6, comprising a spring that biases the spool to the second end of the valve case, wherein the spool is disposed at the second end of the valve case when an electromagnetic force of the electromagnetic solenoid is greater than a biasing force of the spring.

* * * * *